US009616466B1

(12) United States Patent
Bauer et al.

(10) Patent No.: US 9,616,466 B1
(45) Date of Patent: Apr. 11, 2017

(54) GARMENT PROCESSING SYSTEMS, PROGRAMS AND METHODS

(71) Applicant: Huebsch Laundry Company, Eau Claire, WI (US)

(72) Inventors: Klaus Bauer, Elk Mound, WI (US); James Vaudreuil, Altoona, WI (US); John Braff, North Oaks, MN (US)

(73) Assignee: Huebsch Laundry Company, Eau Claire, WI (US)

( * ) Notice: Subject to any disclaimer, the term of this patent is extended or adjusted under 35 U.S.C. 154(b) by 0 days.

(21) Appl. No.: 14/938,165

(22) Filed: Nov. 11, 2015

(51) Int. Cl.
*D06F 93/00* (2006.01)
*B07C 5/34* (2006.01)

(52) U.S. Cl.
CPC ..... *B07C 5/3412* (2013.01); *D06F 93/00* (2013.01)

(58) Field of Classification Search
CPC B07C 3/003; B07C 3/008; B07C 3/08; B07C 5/3412; B07C 5/361; B07C 5/362; B65G 47/48; B65G 2201/0229; Y10S 209/937; D06F 93/00
See application file for complete search history.

(56) References Cited

U.S. PATENT DOCUMENTS 4,239,435 A * 12/1980 Weiss ..... B65G 47/48 104/88.03
4,991,719 A 2/1991 Butcher
5,419,439 A * 5/1995 Branch ..... B07C 5/3412 209/3.3
5,687,850 A 11/1997 Speckhart
5,799,800 A * 9/1998 Lux ..... B07C 3/02 198/349.7
6,050,421 A 4/2000 Hansen
6,695,145 B2 2/2004 Veau
6,768,929 B2 * 7/2004 Roesch ..... B65G 1/1378 198/347.4
7,268,313 B1 9/2007 Aldridge
2003/0019798 A1 * 1/2003 Capps ..... D06F 95/00 209/630
2005/0096956 A1 * 5/2005 Young ..... G06Q 10/08 705/7.38
2014/0052660 A1 * 2/2014 Lee ..... G06Q 10/047 705/338

OTHER PUBLICATIONS

White Conveyors, Comp-U-Sort Garment Sorting Technology, Nov. 2, 2015 http://www.white-conveyors.com/compusort.php.

* cited by examiner

*Primary Examiner* — Joseph C Rodriguez
(74) *Attorney, Agent, or Firm* — Anthony J. Bourget

(57) ABSTRACT

Methods, programs and systems are provided for arranging in correct delivery sequence a plurality of individual garments from multiple delivery routes. A first of two sorting operations utilizes predicted wearer data to create a wearer-rail association where a selection of a plurality of sequenced sorting rails is designated to receive garments according to a set number of predicted wearers/placeholder-wearers, and where the garments of the batch are distributed about the rails based on at least two or more levels of garment designation, including route, stop, customer and/or wearer. The second sort assembles, rail-by-rail, the garments from each of the respective sequenced rails into groups according to wearer which produces a correct delivery order for the batch of garments after only two scan/sort operations and where each garment moves along a non-repeating path.

24 Claims, 7 Drawing Sheets

74

Rail 20

Rail 6 R3W, Stop20, Cust S, Wearer S16-S20; R2W, Stop17, Cust.A,Wearer A1-A8

Rail 5 R3W, Stop 21, Cust. S, Wearer S1-S10, Stop 20, Cust S, Wearer S11-S15

66 66

Rail 4 R3W, Stop 23, Cust B, Locker 2, Wearer B16-B20; Stop 22, Cust Q, Wearer Q1-Q5, Stop 22, Cust. T, Wearer T1-T3, Placeholder XXX, YYY Rail 3 R3W, Stop 23, Cust B, Locker 1, Wearer B1-B10, Locker 2, Wearer B11-B15

Rail 2 R3W, Stop 25, Cust. D, Wearer D15-D19; Stop 24, Cust. J, Wearer J1-J10

66

Rail 1 R3W, Stop 25, Cust. D, Wearer D1-D14; Placeholder ZZZ

FIG. 4

GARMENT PROCESSING SYSTEMS, PROGRAMS AND METHODS

BACKGROUND OF THE INVENTION

1. Field of the Invention

The present invention relates to garment processing systems, software programs and associated methods, and more particularly to garment processing systems, programs and methods of streamlining the process of garment rental or industrial/commercial laundering operations.

2. Background Information

Many companies require employees to wear uniforms purchased by the company. Businesses such as restaurants, laboratories, repair or service stations, manufacturing companies and many others utilize the services of large-scale operations capable of laundering, repairing and returning the garments to the business. Laundry processing systems and methods for servicing numerous garments for numerous customers are known.

Some examples of garment processing systems and methods are found in patents such as U.S. Pat. No. 7,268,313, U.S. Pat. No. 6,695,145, U.S. Pat. No. 6,050,421, U.S. Pat. No. 4,991,719 and U.S. Pat. No. 5,687,850. While these patented systems and other systems and methods may have useful features, there is room for improvement.

SUMMARY OF THE INVENTION

Methods, software and systems are described for arranging in correct delivery sequence a plurality of individual garments. Garments from multiple delivery routes may be batched together for washing, drying and sorting. In one aspect, the system utilizes two separate sorting operations which place all of the garments in a correct delivery order based on route, stop, customer and wearer (and sometime locker or other designation). Simple rails and delivery mechanisms in conjunction with software programming are used such that a proper delivery order is accomplished where garments move along a non-repeating path, eliminating the need for complex or expensive sorting equipment.

In one aspect, after washing and drying, and even absent any pre-scan or pre-identification, garments from multiple routes are identified and placed on sorting rails (sorted) according to a wearer-rail association. With the wearer-rail association, individual wearers are associated with particular rails, so garments belonging to a designated wearer are in turn placed on the rail associated for that designated wearer. The wearer-rail association is created in response to input of the route information (without knowing the presence or absence of any identifiable garments). In one aspect the first sort arranges the garments on different rails based on at least two identifiable levels of garment designation, such as based on route and based on stop designation, and in other aspects the first sort arranges the garments also based on designated customer and based on designated wearer. The rails are positioned in a designated sequence. In one aspect a batch may consist of a single route of garments which may be distributed among multiple rails. The garments are delivered in rail sequence to a second and typically final sort where the garments are correctly arranged by route, stop, customer and wearer. A computer software program is utilized to create the wearer-rail association which predicts wearers to be expected in the batch being laundered. The prediction is based in part on the designated routes which comprise the batch together with historical data and other inputs. A batch of garments may comprise garments from at least two different routes. Actual identification or knowledge of which particular garments are present or the amount of garments that are present (or whether garments belonging to any particular wearer are present) is not required at the first sorting. In one aspect each sorting rail is designated to receive garments associated with no more than a set number of wearers. In one aspect, the number of wearers designated per rail will match the number of slots available or positions designated for sorting at the second sort. In one aspect the entire batch of garments is distributed throughout the plurality of sequenced rails at the first sort, the distribution on the respective rails based on at least two levels of garment differentiation and in some cases four or more levels of differentiation (i.e., route, stop, customer, wearer, locker, etc.). The system accommodates proper ordering of garments which are received unexpectedly.

In one aspect a laundry processing system includes a first sort station configured to inform an operator upon which of a plurality of rails to place a garment, each of the rails designated to hold garments associated with no more than a set number of wearers/placeholder-wearers.

In further aspects the system includes, in addition to the first sort station configured as noted above, a second sort station having a set number (or minimum number) of slots or positions corresponding to the set number of wearers/placeholder-wearers, the second sort station configured to receive information to inform an operator within which of the slots or positions to place a garment.

Route Accounting Systems are stand-alone systems or typically stand-alone systems containing accounting data and other business processing data and capabilities. Garment sorting systems are also stand-alone systems or typically stand-alone systems which sort garments that are presently known or scanned into the sorting system (typically prior to a sort). Heretofore such Route Accounting Systems and garment sorting systems have not been integrated. The present inventors have integrated the systems, having developed a sorting system configured to receive or retrieve real-time backend accounting data to facilitate the sorting process and to do so efficiently and with added benefits of automatic updating of data within the Route Accounting System and including additional process data and management information.

In a further aspect the method includes generating by an application running on a computer system a wearer-rail association where a set number of predicted wearers are associated with a set number of sorting rails. The wearer-rail association is generated prior to identification of any garments to be placed on the sorting rails. A further aspect includes a non-transitory computer-readable storage medium tangibly embodying a set of instructions, which when executed by one or more processors of a computer device, causes the one or more processors to perform the methods addressed herein.

The present methods and systems utilize predicted wearer data to create a wearer-rail association which allows an operator to avoid having to undertake an in-scan of all garments prior to sorting and also avoids having to utilize expensive circulating sorters while still accomplishing a proper route-stop-customer-wearer delivery order after only two sorts. A plurality of sequenced sorting rails is used at a first sort. Each sorting rail is designated to receive garments according to a set number of predicted wearers/placeholder-wearers. Part of the first sorting includes distributing the garments of the batch about the rails based on at least two levels of garment designation, and in some cases four or more levels of garment designation (i.e., route, stop, customer, wearer, locker, etc.). The second sort assembles (rail-by-rail) garments from each of the respective sequenced rails into groups according to wearer. Because the first sort arranges the garments on sequenced rails to at least two levels of garment designation and according to a set number of wearers, a simple second sort of garments (rail-by-rail) which arranges the garments into a set number of groups or sequenced slots corresponding to the set number of wearers for the particular rails, produces a correct delivery order for the batch of garments. An optional third scan ("bundle-sort") may be utilized if desired to correct ordering discrepancies resulting from human error (i.e., placement in a wrong slot) or mechanical malfunction (i.e., hook-release failure) or for other purposes.

The above summary of the present invention is not intended to describe each illustrated embodiment, aspect, or every implementation of the present invention. The figures and detailed description and claims that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which:

FIG. 4 is a table in accordance with an aspect of the present invention.

Figure 1:
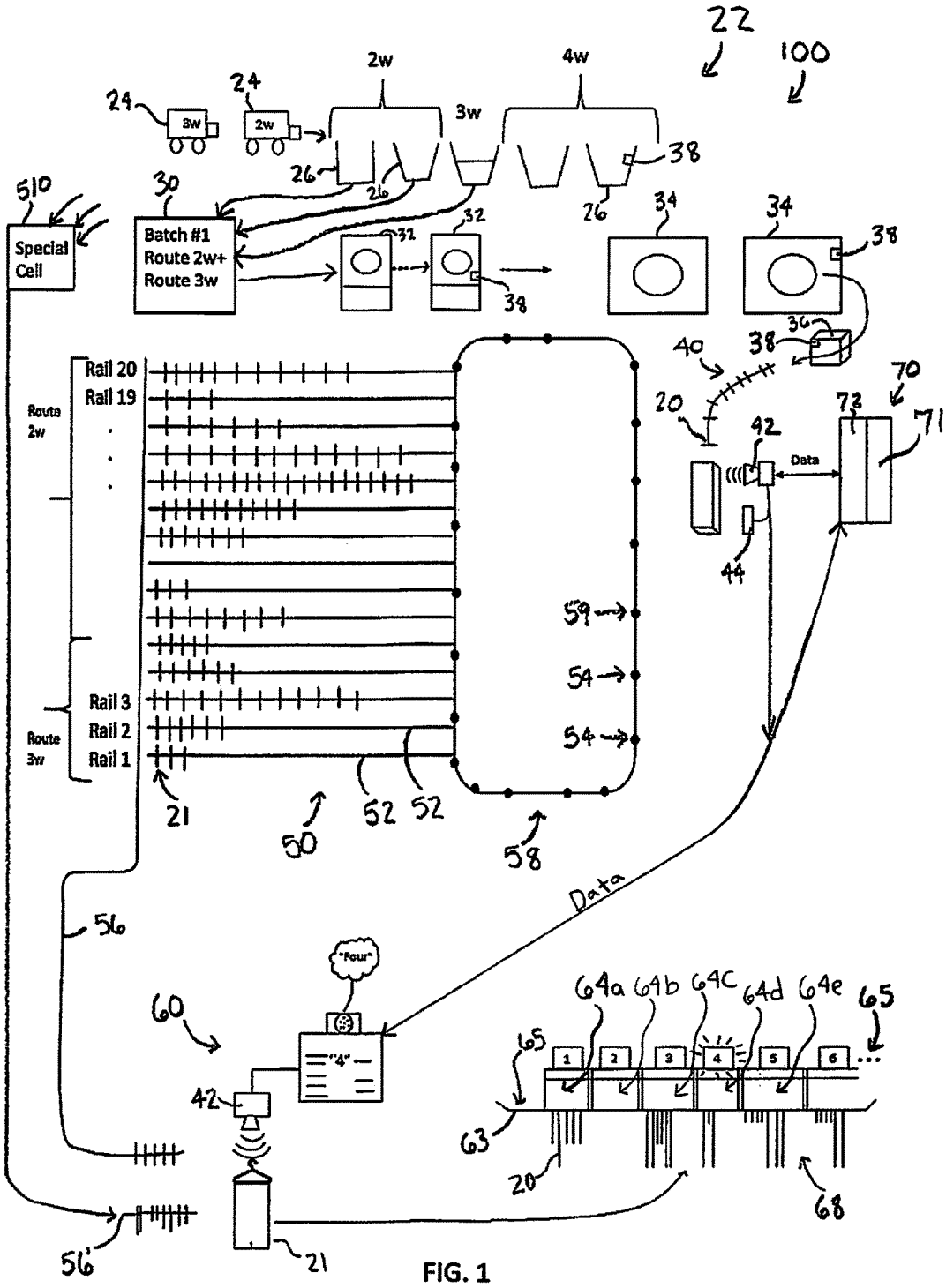
FIG. 1 is a schematic representation of a system and method for laundering and sorting garments in accordance with one aspect of the present invention.
Figure 2:
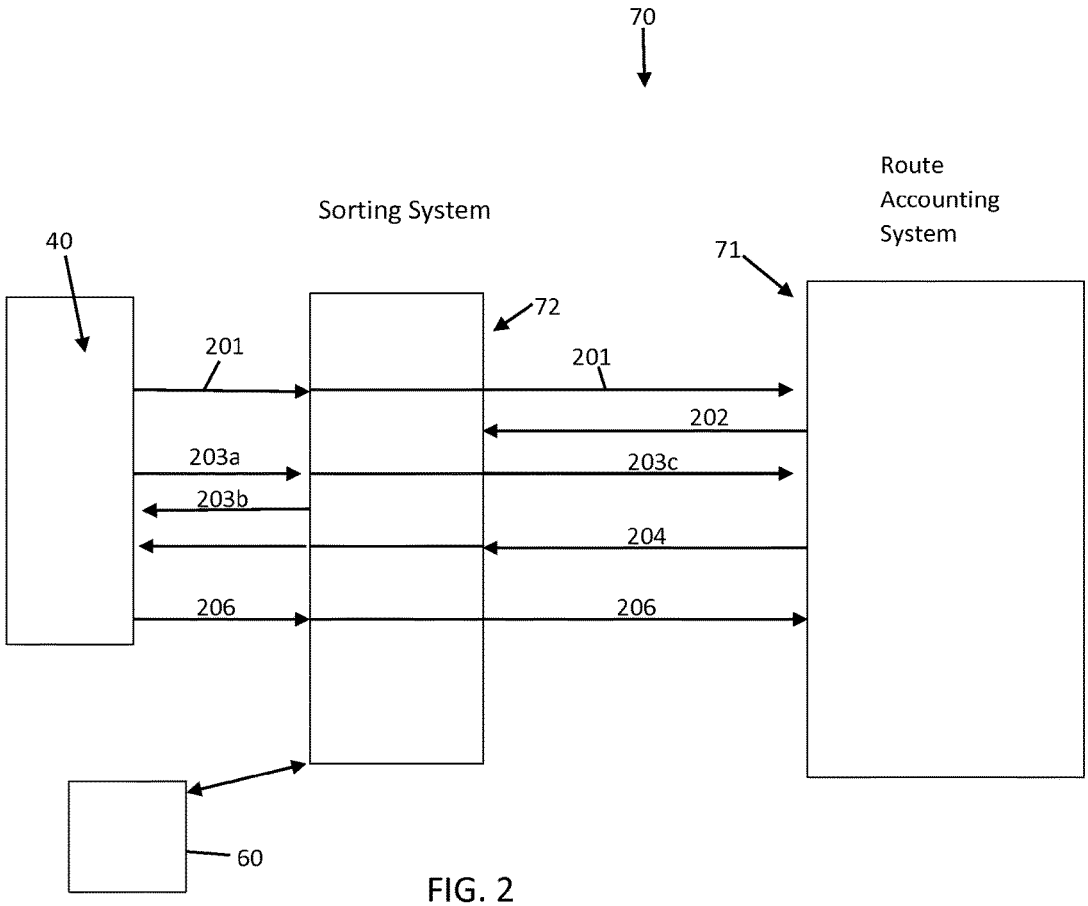
FIG. 2 is a diagram of an aspect of the present invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Methods, systems and software programs are described for sorting articles, such as but not limited to sorting garments. The garments are associated with particular wearers who are in turn associated with a particular customer. In some cases a group of garments belonging to wearers of a customer or multiple customers are picked-up on various routes and delivered to a facility for laundering. Numerous garments are delivered to the facility. Keeping track of the garments and assembling them for transport back to the customer can be a challenge. While various systems and techniques are available for assisting with the assembling task, applicants have found such systems to be overly complicated, expensive, inefficient and/or inadequate compared to the methods and systems of the present invention. Aspects of the present invention allow users to efficiently administer a laundering operation, and to do so at low cost and in ways that provide data, efficiencies and other benefits heretofore unrealized or unrecognized.

According to one aspect, garments 20 are delivered to a laundry facility 22 by vehicles or trucks 24. Garments 20 are assembled into a batch 30, washed, dried, and then presented at a first sort station 40. The batch 30 includes a batch identifier 38 containing information which identifies the batch. An operator inputs the batch identification into a computing device 70 (which in one aspect the computing device includes a front end computer component for sorting, and a backend computer component having route accounting functions, or other aspects). The computing device 70 creates a wearer-rail association and informs an operator upon which of a plurality of sorting rails to place respective garments (i.e., garments associated with the wearer) which garments are identified or scanned at sort station 40. A garment is scanned and delivered to a respective sorting rail according to the information presented at the sort station. In one aspect the garment may be placed on a delivery loop 58 to deliver the garment to one of a plurality of sorting rails 52. In other aspects an operator may place the garments directly on the designated sorting rail without use of a delivery loop. When positioned on the rails, the garments are ordered according to their particular route, stop, customer and wearer information (and sometimes locker room location). When on the rail 52, however, the garments might not yet be grouped according to the particular wearer (for instance the garments belonging to a single wearer, while all located on the same rail 52, may be scattered about the single rail 52). The second sort as described below orders the scattered garments into groups based on the wearer. In one instance the grouping occurs by placing garments belonging to a particular wearer into a location or slot designated for that wearer. The slots may also be arranged in desired order based on stop, customer and route.

In one aspect the positioning information is created at the computing device 70 prior to the scan of any garment. All that remains for sorting the garments into correct delivery order is to sort each individual rail 52. The sorting of garments from each individual rail, which occurs at a second sort station, allows for sorting into groups or slots, and the slot order accommodates for garments on the same rail which are associated with different stops or customers. While present on a delivery rail 52, the garments may be out of order according to the particular wearer. Absent human or mechanical error, however, all garments of the batch 30 pertaining to a particular wearer will be located on a single rail 52 (i.e., garments belonging to a single wearer are not split among rails 52).

The garments belonging to the same wearer are grouped together, into a slot, for instance, during the second sort. The respective rails 52 are sorted in sequence. In one aspect the sequence is to sort Rail 1 prior to Rail 2 prior to Rail 3, etc. In some cases a different sequence may be used. Garments from each rail 52 are transferred in sequence order to common rail 56 and presented to second sort station 60. In one aspect data pertaining to the garments which were actually scanned at the first sort is received from computing device 70 and provided to sort station 60. At second sort station 60 each garment is scanned (for only the second and last time or typically the last time) and delivered to a slot 64 according to the information presented at station 60. Each separate slot 64 pertains to a separate wearer of the garments. The slot order may also be arranged to accommodate different stops and/or lockers and/or customers and/or routes. When the slot row 62 is filled with the particular garments the sort station 60 presents an instruction to clear the slot row 62 (an operator may slide the garments along the rail for staging or storage or delivery, for instance (i.e., to delivery carts)). A next group (or rail) of garments then proceeds through second sort station 60 to be slotted according to wearer information. The entire batch 30 will be scanned at sort station 60. Upon processing each of the garments of the batch through the first sort and the second sort, all of the garments of the batch 30 are arranged in correct route delivery order.

The garments follow a non-repeating path through the system such that any single garment need not duplicate any path or portion of a path along the system while still ordering all of the garments in correct route delivery with only two scans or identifications of each garment.

The two sort system of the present invention accomplishes a correct sort (based on route, stop, customer, locker and wearer) where all of the garments of the batch move along a non-repeating path, i.e., there is no requirement to purchase expensive sorting machines which circulate or cycle garments around a loop or otherwise retrace a path to place the garments into proper position. There is no requirement to place the garments in a buffer or storage area and then bring the garments (whether an entire batch or portion of a batch) back for further sorting. Basic rail and conveyor machines accomplish the correct sort, in conjunction with a programmed computing device, with a single pass of the garments. The system 100 also provides real-time information to and from operators and assembles management data as noted below.

Embodiments of the present invention include various steps as described herein. The steps may be performed by hardware components or may be embodied in machine-executable instructions, which may be used to cause a general-purpose or special-purpose processor programmed with the instructions to perform the steps. The steps may also be performed by a combination of hardware, software, firmware and/or by human operators.

Embodiments of the present invention may be provided as a computer program product, which may include a machine-readable storage medium embodying tangible instructions. The program product may include a non-transitory computer-readable storage medium tangibly embodying a set of instructions, which when executed by one or more processors of a computer system, cause the one or more processors to perform methods as presented herein. The instructions may be used to program a computer (or other electronic devices) to perform a process. The machine-readable medium may include, but is not limited to, fixed drives or hard drives, magnetic tape, floppy diskettes, optical disks, compact disc read-only memories (CD-ROMs), DVDs, thumb drives, magneto-optical disks, semiconductor memories, such as ROMs, PROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e.g., computer programming code, such as software or firmware). Embodiments of the present invention may also be downloaded as one or more computer program products. The program may be transferred from a remote computer (or run from a remote computer) to a requesting computer by way of data signals embodied in a carrier wave or other propagation medium via a communication link, such as via a modem or network connection or via remote computing, and including via wireless communications. The program may also be provided as a product or service in the nature of SaaS or software as a service.

In various aspects, the computer program products, or the articles of manufacture, containing the computer programming code and/or software may be used by executing the code directly from the machine-readable storage medium or by copying the code from the machine-readable storage medium into another machine-readable storage medium (for example, a hard disk, RAM, etc.) or by transmitting the code on a network for remote execution, or by transmitting instructions or data generated by the code on a network or for remote execution. Various methods described herein may be practiced by combining one or more machine-readable storage media containing the code according to the present invention with appropriate standard computer hardware (including handheld devices) to execute the code contained therein. An apparatus for practicing various embodiments of the present invention may involve one or more computers (or one or more processors within a single computer), including one or more mobile or remote computing devices, including but not limited to tablet computers and/or smart phones, and storage systems containing or having network access to computer program(s) coded in accordance with various methods described herein, and the method steps of the invention could be accomplished by modules, routines, subroutines, or subparts of a computer program product and/or a mobile application software program.

As used herein, the following terms have the associated brief definitions shown below.

"Batch" is a collection of garments from a delivery or pick-up route, or from multiple routes (or from a portion of a route).

"Route" is a path traveled by a truck, trucks or pick-up vehicles which pick-up garments at various stops or at customer locations, and the term is also associated with a position on a sorting rail or rails. A garment associated with a route is a garment associated with a particular wearer, customer, locker or stop within or along the route.

"Stop" is a position or location on a route, and the term is also associated with a position on a sorting rail or rails. A stop may be at a single customer location, or there may be multiple customers at a stop. There may be multiple stops on a route.

"Customer" is a single paying account or client desiring to purchase laundering service, and the term is also associated with a position on a sorting rail or rails. A customer may comprise multiple stops and even multiple routes. A customer may also have multiple locker rooms. A customer comprises multiple wearers.

"Locker Room" is a facility of a customer, and the term is also associated with a position on a sorting rail. A customer may have multiple locker rooms at the same location or at different locations and utilized by employees or wearers. Garments may be delivered to a locker room or storage area of the customer.

"Wearer" is a person who wears garments, and the term is also associated with a position on a sorting rail or designation of a wearer's garments with a sorting rail. For instance, there exist various "wearer" positions or associations with a rail, and garments associated with a particular wearer will be placed on the rail pertaining to a designated wearer. Garments include, for instance, pants, shirts, robes, bibs, uniforms, and other clothing. In some aspects a wearer also includes a placeholder-wearer. Any number of garments may be associated with a wearer. Garments also have an associated wearer, stop, customer, route, batch and sometimes locker room or other identifiers.

In one aspect a "Cell" is a facility which includes a sorting station (with a scanner and a display device configured to deliver garment-rail and/or wearer-rail location information received from a computing device) and an associated rail system for sorting scanned garments. A cell may also include washing and drying equipment and a second or additional sorting stations. A cell may also include specialty processing or handling areas.

Referring to FIGS. 1-7, further aspects of the systems, programs and methods of the present invention are shown. In one aspect, FIG. 1 depicts system 100 of the present invention shown in a schematic example. FIG. 1 also shows a schematic example of a garment processing method.

The garments 20 may be provided to a facility 22 by delivery trucks 24. Garments 20 may be delivered by other means. Each truck 24 is associated with a respective route or routes. Garments 20 taken from a truck 24 or a route are placed in a bin 26 or bins 26. A bin 26 or bins 26 may be associated with a particular route or routes. In one aspect a route may be designated by the date or day of pick-up and with the number or designation of the route (other designations may be utilized). For instance, a truck 24 that makes deliveries and pick-ups of garments 20 on a Wednesday along or on route number 2 may be designated as Route 2W. A number of trucks 24 and/or bins 26 may be associated with a route such as Route 2W. A different truck 24 or trucks 24 may pick-up garments on a Wednesday along route number 3, designated for instance as Route 3W. Different route designations may be used to designate respective routes. Several routes may be designated and utilized during a day, week, month, year or other periods. As shown in FIG. 1, bins 26 correspond to multiple routes. For instance Route 2W includes two bins 26 holding garments, Route 3W includes a single bin 26 holding garments, and Route 4W includes two bins holding garments 20. Several bins 26 may be utilized to contain garments from a single route and multiple routes of garments may be delivered to facility 22.

An operator creates a batch 30 of garments 20. The operator may do this based on experience or may do so by trial and error or by direct instruction or guidance. Allowing the operator flexibility in creation of a batch 30 allows the operator to gauge the capacity status of the washing and drying equipment and mix or match routes (and varying volumes of garments) as desired or appropriate. As noted below, such flexibility is also useful in a multi-cell system where several cells are present in a single facility. Also as noted below, the system and cells are scalable for easy expansion and modification. Additional cells may be added or removed as desired. A batch 30 may include garments from a single route or from multiple routes. In the example of FIG. 1 batch 30 comprises garments derived from Route 2W and 3W. An operator may decide to mix various routes to create a desired batch. A batch 30 may comprise garments from combined routes and combined customers. Such combination allows the operator to determine an efficient load or loads of similar garments for washing. For instance, if the operator determines that garments from different routes can logically be grouped together to make a full or different wash load (taking into consideration factors such as machine capacities and availability, machine speed, type of garments, types of dirt or soiling of the garments, wash/detergent or bleach formulations, and other batching considerations), the operator may make such groupings or batches. Garments from different routes/customers may be combined into a single or different batches 30. In one aspect the batch 30 is processed at a first cell 110. In other examples the invention includes use of multiple cells 110, 210, 310, 410, 510 as addressed below.

With further reference to FIG. 1, batch 30 consisting of dirty or soiled garments to be laundered is delivered to washing machine 32 or machines 32. Shirts and pants and other garments may be separated in the wash loads (i.e., by type such as shirts/pants, etc., by color, by other washing criteria). After washing, the garments are dried in or at dryers 34. A variety of different types of washers 32 or dryers 34 may be used. Small batches or large batches may be assembled depending on the size of the equipment at facility 22 or depending on desired wash formulations (some garments may require different wash formulations compared to other garments, etc.). Large industrial size washing machines and dryers (holding several hundreds of pounds each) may be used as well as smaller machines (handling loads of 200 to 100 pounds or even less). The dried garments may be placed in a hopper 36 or hoppers 36 and delivered to a first sort station 40. A batch identifier may be used to identify the particular routes present in a batch, such as batch identifier 38. Identifier 38 may be a slip of paper or sticky note or electronic notation or other identifier, which is associated with a batch 30 and respective washers 32, dryers 34, bins 26 and/or hoppers 36 or other devices. Particularly, one example of an identifier 38 may display the route information which comprises the batch 30. In the example as shown in FIG. 1, for instance, the identifier 38 includes a marking on a piece of paper such as 2W/3W representing "route two" and "route three" having garments picked-up on Wednesday of the given week. An operator may create and/or display the identifier 38 with the batch 30 and the respective wash/dry loads as they progress through the system 100. For instance, the identifier 38 may travel with its associated batch 30. An operator may mark the route information on the indicator 38. An operator may also enter the identifier 38 into a computer upon creation of the batch so that the identifier information is available at the washers 32, dryers 34, bins 38 and/or at the sort station 40.

A special cell or special treatment location 510 may also be utilized. Special cell 510 is used for special garment treatment such as pressing, starching, dry cleaning, repair or other special treatment. There may be multiple special cells 510. Garments delivered to special cell 510 do not follow the typical laundering sequence for garments which are delivered to washers 32 and dryers 34. The special cell garments are or may be brought back to respective batches 30 later in the process as described below. Special cell 510 may receive garments from several different routes, and the routes do not necessarily have to correspond with any particular batch. Garments from special cell 510 may be matched or combined with garments of a batch 30, or of different batches, later in the system and in methods as described below.

In one aspect after garments are washed and/or dried the garments 20 are individually hung on a hanger and inspected. An operator may remove a garment from a hopper 36 for processing and may optionally hang a series of garments on a temporary rail for processing. In one aspect an operator will send a signal or cause a signal to be sent to a computing device 70 to initiate a sorting operation as described in detail below. Each garment is equipped or configured with a tag or an indicator. A tag or indicator includes or emits a signal or a unique code associated with each garment, and includes information such as the route, stop, customer, locker room, wearer or other information associated with the garment. Additional information may also be associated with the tag or indicator. The tag information for each garment is stored in a database so that upon identification of a garment, the associated wearer, customer, locker, route and other information may be ascertained. In one aspect a tag is an RFID tag connected to a garment. The tag may be a passive tag. It may be appreciated that other varieties of tags or indicators or unique code devices may be used. A barcode may be utilized. Each garment may include a tag and may be "scanned" by a compatible scanner for identification and subsequent processing. Each garment may also include a human readable indicator containing the same information as with the RFID tag.

At first sort station 40 the garments are scanned with a scanning device 42. Scanning device 42 may be a stationary or a handheld or a portable scanner. In one aspect each garment is scanned individually or one-by-one. The scanning device 42 sends a signal to computing device 70 and an associated rail or hook location information is returned or announced/displayed to the operator. The associated rail or hook location is identified so that an operator may place the garment on a designated sorting rail 52 of a sorting rail system 50. Rail system 50 includes a plurality of sorting rails 52 configured to receive garments placed on hangers. Multiple garments may be placed on an individual rail 52. In one aspect a rail 52 may be approximately 6 to 8 feet in length, although other lengths (shorter or longer) may be used as desired. The garments are transported from the individual rails 52 of sorting rail system 50 to a single sort rail 56. Garments from single sort rail 56 may be transported to second sort station 60. Garments are further sorted at station 60 and from second sort station 60 are moved to a tie-out station and/or placed on trolleys (made "route ready") and/or moved to temporary storage and/or loaded on to delivery trucks 24. Garments from special cell 510 or other cells may be included with the second sort at station 60. Further aspects of the sorting operations and methods which occur at station 40 and station 60 are described herein.

After the garments are washed/dried, they proceed to first sort station 40, then to sorting rail system 50, then to second sort station 60 and then to tie-out, storage, staging and/or to delivery vehicles. Garments which may have been diverted to special cell 510 are combined at second sort station 60. In addition to addressing the flow of garments, the devices, systems and methods of the present invention also relate to the flow of information or data associated with the garments and their respective wearers, customers, routes, stops, locker rooms, etc., and also present efficiency data, such as employee and system efficiency, cell efficiency, process efficiency and corresponding reporting or reports. The devices, systems, programs and methods of the present invention may be configured and/or utilized for web-based operation and licensed to others as software as a service as described herein.

Figure 3:
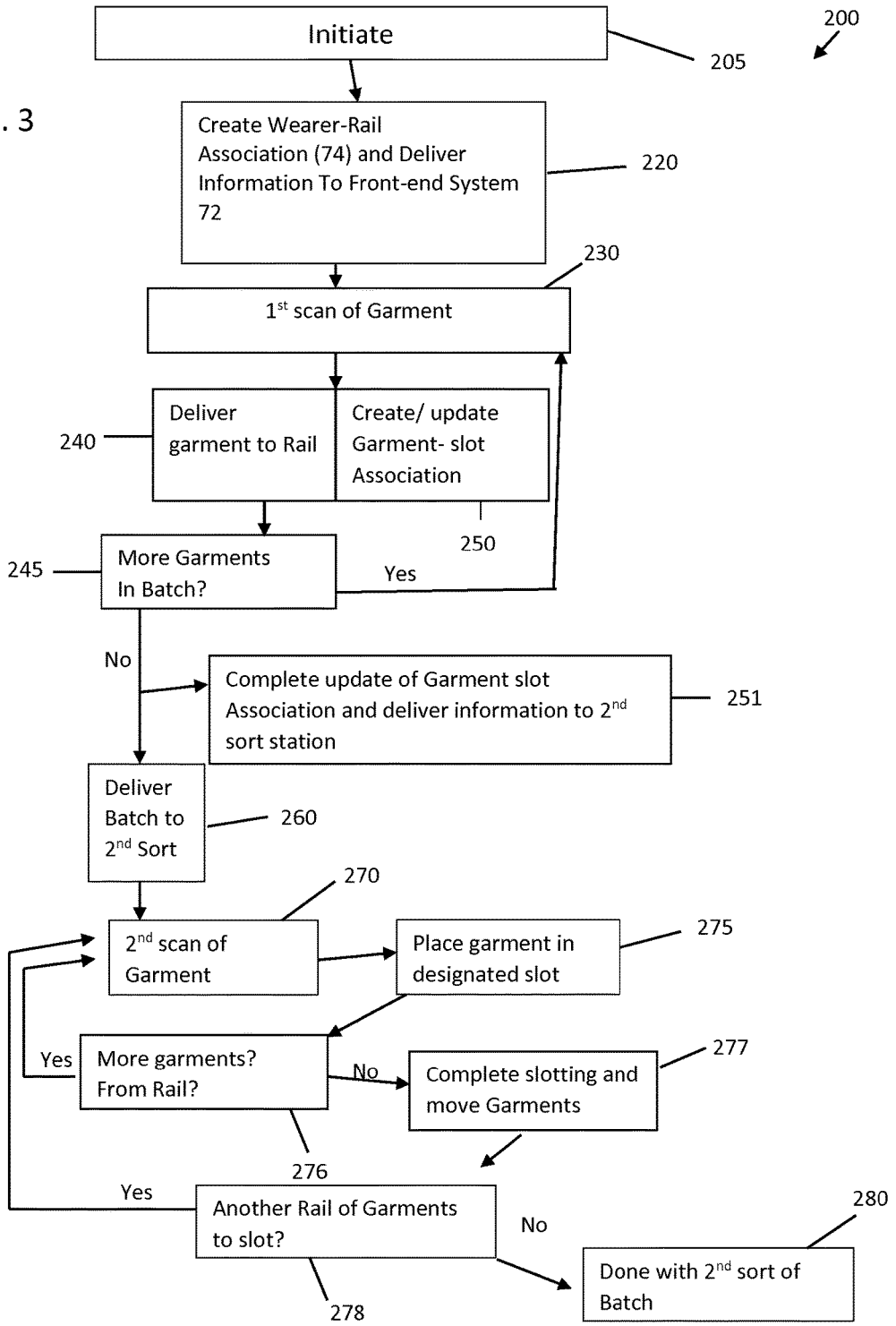
FIG. 3 is a flow diagram of an aspect of the present invention.

In one aspect of the invention a garment processing method 200 is initiated at step 205 and begins at first sort station 40 (See FIG. 3). When the garments of the batch 30 reach first sort station 40, an operator will initiate step 205 by entering the route information (i.e. 2W/3W) into the terminal or front end sorting system 72 or user interface associated with computing device 70. An initiation step 205 includes, for instance, sending a signal 201 (See FIG. 2) (corresponding to the route information (i.e., 2W/3W)) to a computing device 70 such as a computer or computers and/or to sorting system 72. The signal information sent to the computing device 70 or sorting system 72 includes information pertaining to the batch 30 and/or route or routes pertaining to the batch 30 to be processed. In one aspect an operator will enter data (or select data entry buttons or icons or pre-set profiles) into a terminal (via keyboard or touch screen monitor 44 or other input device) associated with front end sorting system 72. The data (represented in signal 201) includes information pertaining to the batch 30 to be processed. In one aspect information contained on a batch identifier such as identifier 38 described above is used or received by the computing device. The device 70 may prompt the operator for input of the batch or route information 201 to be sorted (at which point the user enters or activates the route information contained on indicator 38). In one instance, a user may scan a garment 20 which indicates at least one associated route. The backend system will recognize the garment and associated route and return a profile or variety of profiles for consideration (such as when scanning a garment from Route 2W, the returned profile can be a set of candidate or optional profiles where route 2W has been previously used, such as in a previous batch 2W/3W, batch 2W/4W, or some other prior batch profile or set of prior profiles that may have been utilized). This allows an operator to conveniently select/input the desired batch information into the system (as opposed to immediately inputting the particular batch from a batch identifier 38). Of course, an operator may simply input the particular route information associated with the batch 30. In a further aspect, and upon scanning the garment from Route 2W at station 40, the system 100, knowing the associated indicator 38 and batch previously entered into the computer, will recognize the start of the batch 30 to be processed.

The route information input by the user is delivered to computing device 70. In one aspect computing device 70 includes a back-end system such as Route Accounting System 71 and/or a front-end-system such as Sorting System 72. In further aspects it may be appreciated that computing device 70 may include a single integrated system (both back-end and front-end). The computing device 70 may include a computer or set of computers and associated software and related interface and storage equipment. The route information delivered to computing device 70 is carried by a signal 201 and recognized by system 71 which recalls previous data associated with the respective routes. For instance, the backend system 71 will have stored information regarding the respective routes that have been processed previously. Such route processing information will or may include the respective route number, date, stop information, customer identification and information, locker information, wearer information, garment information, billing information, identity of specific garments 20 previously laundered, etc. Such historical data is utilized by system 71 to recall or create a predicted wearer-rail association 74 (See FIG. 4, for example) for the batch 30.

After initiation at step 205 the system 200 includes a step of creating a wearer-rail association 74 (step 220). The wearer-rail association 74 is addressed in greater detail below. The association 74 in the form of a table or data may be delivered to or received by front end system 72 (and at sorting station 40). A garment is scanned (step 230) at sort station 40 which in turn causes rail information to be provided to the operator. The operator delivers the garment to the designated sort rail (step 240). In one aspect, a garment-slot association 75 is created or updated (step 250). If there are more garments of the batch 30 remaining to scan (query at block 245), the garment is scanned and delivered to a designated rail (step 240). If there are no more garments in the batch to scan, the garment-slot association 75 is updated and/or completed (step 251). The creation of the garment-slot association 75 is address in greater detail below. When there are no additional garments in the batch or to be scanned, the garments of the batch are delivered to second sort station to be sorted (step 260). All of the garments of the batch are removed from the sorting rails and delivered to the second sorting station. After the garments have been scanned at the first sort (and prior to removal of the garments from the sort rails) it may be appreciated that the garments are positioned on the plurality of sequenced sorting rails based on at least two levels of garment designation. For instance, a garment may have several levels of designation, such as the garment's route, stop, customer, locker and wearer (among other levels). In further example, the garments are arranged on sequenced sorting rails at least according to their respective routes and stops (two levels of garment designation), and in further aspects they are arranged based on their respective routes, stops and customers (three levels of garment designation) and in further aspects they are arranged in their respective routes, stops, customers and wearers (four levels). Additional garment designation levels may also be realized, such as based on locker room or other designation. In further aspect, once the garments have been placed on the rails following the first sort, garments on respective rails have already been differentiated from garments on all other rails based on identifiable route, stop, customer and wearer designation. Garments belonging to a particular wearer will all be contained on the same rail. In some aspects, garments belonging to the same route (and/or stop and/or customer and/or locker) will be placed on different rails; while garments belonging to the same wearer will remain on the same rail. Absent human or mechanical error, all garments belonging to the same wearer will always be placed on the same rail.

In one aspect the garments are removed in rail order to a common rail 56 leading to second sort station 60 (step 260). The garment-slot association 75 information is also delivered to second sort station 60 (step 251). Thereafter a garment from a rail of the batch (having been delivered in rail order from the first sorting rail system 50) is scanned (step 270) and placed in a designated slot (step 275). Further details of the scanning and placement of garments into slots are addressed below. If more garments from the associated rail are present (query at block 276), the garments are scanned (step 270) and delivered to a designated slot (step 275). If there are no more garments present from the associated rail (query at block 276), the slotting of the garments for that rail is completed (step 277). The slotted garments are moved to a different rail or trolley to make room for the next rail of garments to be slotted. If garments associated with another rail are present at second sorting station (FIG. 3; query at block 278), those garments are scanned individually (step 270) and slotted (step 275) until all garments of the associated rail have been scanned. The slotting continues rail by rail. The second sort process repeats until (ends at step 280) all garments from all of the associated rails of the batch 30 have been scanned and slotted. Upon completion of the second scan and slotting at station 60, all of the garments are in correct delivery order (barring any human error in misplacement or barring mechanical error of equipment, and also subject to insertion into the batch from any special cell). For instance, the garments are properly arranged in the correct delivery order sequence according to Route, Stop, Customer, Wearer (and also locker if desired). The garments are transported to holding or staging for placement on vehicles for route delivery. The first garments loaded into a truck may correspond to the last garments on the route to accommodate for efficient delivery in the field. For instance, the garments associated with Rail 1 may be the first garment loaded into a delivery vehicle and the last garments (last stop) on the route. After the garments have been removed from the sorting rails of the sorting rail system 50, another batch of garments having been laundered may be processed by initiating another processing at step 205. The rail system 50 is available for the next batch. Sorting (first sort and second sort) may occur simultaneously for multiple batches. For instance, sorting of a batch at station 60 may proceed while sorting of a different batch proceeds at station 40.

Creation of the wearer-rail association 74. In one aspect, computing device 70 or back end system 71 recalls the last wearer-rail association for the batch (or particular route) and/or creates a new wearer-rail association 74 for the present batch (or present routes). In one aspect the wearer-rail association 74 is information of a data file which may be represented in a table form shown generally in FIG. 4. The table may be represented differently as desired. It may be appreciated that a different wearer-rail association or associations may be made for each respective batch 30 and/or route or route combination by drawing from the respective historical data and combining it and manipulating it into an operable wearer-rail association 74 (See FIG. 4) to be used for the present sorting. Computing device 70 (and associated back end system 71) include software and a program and/or algorithm to recall and/or generate the wearer-rail association 74. The program may be used to generate the association based on variables and inputs or data present in a database or updated database associated with computing device 70. Commonly available algorithms may be used to perform the generation of the wearer-rail association in step 220. Special algorithms may also be used for creation of the wearer-rail association. The software product/program may reside at computing device 70 and may also reside, in whole or in parts, at other computing devices, and may reside at front end 72. In one aspect, front end 72 is positioned at or integrated with sort station 40. Sort station 40 may include a computing device where the software program resides or is operable.

In non-limiting aspects, a computing device 70 may be also be a computer system having a bus, at least one processor, at least one communication port, a main memory, a removable storage media, a read only memory, and a mass storage. A computer system may include a processor or processors which among other things, is generally responsible for executing various operational instructions maintained in a main memory, and processing and otherwise interacting with various other input/output devices, such as internal and/or external context data sources. Processor may receive data from RFID reader or other input device. Communication ports may also be included in conjunction with computing device, which may be of an audio port, modem connection, Ethernet port, wireless ports, other communication ports. Main memory can be Random Access Memory or any other dynamic storage device commonly known in the art. Read only memory can be any static storage device such a Programmable Read Only Memory chips for storing static information such as instructions for processor. Mass storage can be used to store information and instructions, for example, hard disks or other storage mechanism. A bus communicatively couples processors with the other memory, storage and communication elements. In the case of a server or desktop computer or laptop or portable device, operator and administrative interfaces, such as a display, keyboard, cursor control device, touch screen, may also be coupled to bus to support direct operator interaction with the computer system. Other operator and administrative interfaces can be provided through network connections connected through communication ports. Removable storage media can be any kind of external hard-drives, floppy drives, zip drives, CD-ROM, DVD, SD card, etc. REFI readers include an RFID antennae to send a signal to RFID tags within range and an RFID sensor to sense/read the RFID tag responses. RFID reader may be external (coupled to the computer system via communication port) or integrated with the computer system (coupled to the bus).

In one aspect the invention comprises generating the wearer-rail association where each of an anticipated wearer is associated with a particular rail of a plurality of rails. The particular garments belonging to a rail are not necessarily directly associated with a rail, rather, a wearer is associated with a rail (anticipating that at least some garment or garments belonging to the wearer will be present in the batch). Because each of a particular garment is associated with a particular wearer (typically via a pre-set association table), the individual garments will indirectly have a pre-set location reserved on a rail (although the individual garments are not yet known to be present in a batch and are not directly associated with any rail). Each rail is designated to hold garments associated with no more than a set number of wearers. In one aspect there is no need to track the anticipated number of garments to be placed on a rail. The wearer-rail association is used for a first sort of garments. In addition to generating the wearer-rail association, a further aspect of the invention includes sending the wearer-rail association information to a facility. The sending may include sending of a wearer-rail association table to a user or facility remotely.

The wearer-rail association 74 is created and presented to or within the computing device 70 or otherwise made available at step 220 and presented or communicated to front end sorting system 72 so that sorting system 72 is poised to provide instruction to an operator as to where to place a given garment. For instance, the operator initiates the method (at step 205) by providing the batch information 201 (i.e., Route 2W/3W) and the computing device 70, such as back end 71, generates or presents a wearer-rail association 74 and sends (data flow 202) the association data 74 to sorting system 72 (and/or retains the information for use in computing device 70 in conjunction with the system). When sorting system 72 receives the association data 202, sort station 40 is ready for individual sorting and scanning of garments 20. At this point the rails have already been segregated according to the predicted wearers (irrespective of, and not even actually knowing, the particular garments that are included in the batch or even if the garments are associated with any of the predicted wearers).

In one example, a particular wearer may send 5 pants and 5 shirts to be laundered on week 1, and a different set of 5 pants and 5 shirts to be laundered on week 2, etc. Several historical periods may be considered. One might attempt to predict the particular garments that are to be received, but that is not necessary. While it may do so, the system of the invention need not be configured to predict the particular garments to be laundered, or even the number of garments to be laundered, but does operate to predict that garments for particular wearers are to be included in the batch and in the wearer-rail association. The wearer-rail association 74 is based on a prediction that garments for the wearer will be part of the batch 30. The prediction is made without knowing or attempting to predict which garments or how many garments are associated with a wearer. In some cases, there may be no garments received for a predicted wearer, and in other cases there may be garments received for an unpredicted wearer, or in many cases there will be garments received pertaining to the predicted wearer. The system is configured to accommodate these variations, and does so by predicting that garments for particular wearers will be included in the batch. When a wearer sends garments to be laundered in any given week or other occurrence, it is unknown which of the many garments associated with the wearer, or if any garments associated with the wearer, will be included in the batch. The software nonetheless includes a prediction which may include the wearer in the wearer-rail association. In some cases a wearer is not included in the wearer-rail association, so the system creates a placeholder/wearer association to accommodate for such unexpected situations as noted below.

With respect to FIG. 4, one example of a wearer-rail association 74 is represented. The association 74 shown in FIG. 4 represents an example of a batch 30 (or portion of batch 30) where the garments of Route 3W include: Stops 20-25, Customers D, J, B, Q, T and S, Customer B includes Locker 1 and Locker 2, and the respective customers include various wearers designated as follows: Customer D: wearers D1-D19 (i.e., Customer D has 19 separate wearers); Customer J: J1-J10; Customer B: B1-B20; Customer Q: Q1-Q5; Customer T: T1-T3; Customer S: S1-S20. A wearer (or locker) cannot or ideally should not be split on two different rails. For instance, a garment belonging to Wearer D17 should be placed on rail 2, not rail 1 or other rail. FIG. 4 also shows a portion of the batch 30 associated with Route 2W (or at least a portion of Route 2W as shown at Rail 6). It may be appreciated that wearer-rail association 74 designates each rail 52 with an associated wearer and may also include an associated group of route, stop, customer and/or locker. In the case of rail 1, a placeholder wearer ZZZ designation 66 is provided. In the case of rail 4, two placeholder designations 66 (XXX, YYY) are provided. The association 74 of FIG. 4 is representative only of one example of how the software and database will utilize, recall or create the wearer-rail association 74. Again, the association 74 is or may be created prior to scanning or identification of a garment of the related batch 30. The association 74 is a predicted expectation of the wearers (not the garments) (i.e., simply that garments belonging to the designated wearers are expected) anticipated to be received for processing in the system 100. The placement of the wearers among the various rails is made according to a predicted order of delivery (with wearers placed on Rail 1, for instance, appearing toward the last stop or stops on the Route and wearers placed on Rail 20, for instance, appearing toward the first stop or stops on the Route). It may be appreciated that a second sorting of the garments is streamlined (or made possible) by the optimizing or the selective dispersing of the wearers (and/or lockers and/or customers and/or stops and/or routes) about the plurality of rails in a manner most consistent with a correct final delivery order. For instance, it would not be optimal in the example of FIG. 4 to place garments associated with Wearer D1 on Rail 6. It also would not be optimal to place garments associated with Stop 25 on Rail 3, for instance. It is optimal to keep wearers together and to keep Lockers, Customers, Stops and Routes together on the same Rail or at least on immediately adjacent Rails. While garments belonging to different stops or customers or routes may be placed on different rails, garments associated with a particular wearer should not be split among multiple rails.

If an unexpected garment is scanned at station 40, it will be placed at an appropriate placeholder wearer designation on a rail 52 (or on one of the several rails 52 as is calculated by system 100). For instance, if an unexpected garment is scanned which belongs to a wearer who logically belongs to Route 3W and is associated with stop 23, Customer B, locker 2, or with stop 22, Customer Q, or stop 22 Customer T, the unexpected garment will be placed on rail 4 (See FIG. 4). The unexpected garment (belonging to a particular wearer) may be associated with Customer T, for instance; therefore the program may designate the garment with placeholder wearer XXX. If another unexpected garment is scanned and relates to the same wearer as associated with placeholder wearer XXX, that garment will also be placed on rail 4. If yet another unexpected garment is scanned, and the garment is associated with an altogether different wearer, yet with the same Customer T, for instance (or with some other Customer on that rail 4), a further placeholder 66 will be utilized such as placeholder wearer YYY. Any further garments associated with such wearer will be delivered to rail 4 (where garments for placeholder wearer YYY are delivered). A placeholder wearer 66 may be designated for each rail 52. In further aspects two or more placeholder wearers 66 may be associated with a rail 52 or with each of the rails 52. In other aspects a rail may be designated to hold only or all unexpected garments.

In one example the number of wearers designated per rail 52 is a set number of wearers. For instance, as shown in FIG. 4, the wearer-rail association is created such that each rail 52 contains 15 wearers (a Placeholder is counted as one of the wearers). A different value may be selected for the set number of wearers to be associated with a single rail. More or less than 15 wearers per rail may be established as desired. The system may be programmed, for instance, such that garments associated with no more than 15 wearers (including placeholder wearers 66) are to be included on a single rail 52. In such case where a customer comprises more than 15 wearers, for instance, the garments may be designated to be placed on multiple rails. For instance, both rail 1 and rail 2 may receive garments from customer D. It may be appreciated, however, that use of a placeholder 66 or multiple placeholders 66 may allow the association 74 to avoid splitting garments belonging to the same customer (or avoid splitting garments belonging to the same route or the same stop or the same locker or the same wearer). In other cases where a customer includes numerous wearers, it may be important to still separate the garments on different rails based on stop and/or locker room (and in some cases even based on route).

Prior to scan at step 230, the wearer-rail association 74 is created. Once a garment is scanned, a garment-slot association 75 is created or updated (See FIG. 5). The garment-slot association 75 includes a list or table of garments that have actually been received and scanned, together with an associated slot 64 (See FIG. 1) to which the garment is associated. Additionally, the wearer associated with the particular garment is also provided or available. As may be appreciated, all of the garments associated with a particular wearer are designated to be slotted in an individual slot 64 associated with that wearer. Additional information regarding the garment-slot association and second sort is provided below.

At first sort station 40 an operator scans a garment 20 (step 230) and the corresponding data 203*a* (See FIG. 2) of the garment 20 is input to sorting system 72 (i.e., scan information from a tag associated with the garment) which in turn causes a resulting rail number or designation to be displayed or communicated to the operator (i.e., by a data signal 203*b* sent from sorting system 72 to station 40, or displayed at system 72 and station 40). Particularly, the individual garment is scanned which is associated with a wearer, and because the wearer has been designated or associated with one of the plurality of rails 52, the garment is in turn associated with the designated or associated rail (corresponding to its wearer). Scanning the garment, which is associated with a wearer, will cause a display of the associated rail (corresponding to the particular wearer) at sort station 40 so that an operator may place the garment on the displayed rail.

The wearer-rail association 74 in one aspect is stored in a file or database at sorting system 72 and utilized in the form of sending the data signal 203*b*. In one aspect the association 74 is sent (at data signal 202) to system 72 or pulled from system 71 as a complete file poised to handle whatever garments 20 will be scanned at station 40 (without knowing exactly what garments 20 are contained in the batch 30). Upon communication to the operator of the designated garment-rail association 74, the operator places the garment 20 on the associated rail 52. For instance, an operator may scan garment 20 and in turn an associated rail or hook number is displayed or communicated to the operator (for instance at monitor 44, or presented with a verbal indication of the designated position). The operator places the garment on the associated rail 52 of rail system 50.

In one aspect of the invention, in addition to the scan of a garment at step 230 providing wearer-rail indication of where to place the particular garment, back-end information (such as quit orders, special requests, wrong route/batch notification, or other information delivered by or generated by back-end system 71) is also utilized by the system 100. Such back-end information may be delivered to sort station 40 in real-time for an operator to observe. For instance, when a scan is made at station 40 the data signal 203*a* is sent to system 72 which returns the Wearer-rail information 203*b* (and/or garment-rail information) to station 40 and simultaneously a data signal 203*c* is sent to backend 71. Backend 71 will recognize the garment 20 and is configured to return a data signal 204 representing real-time backend data (such as a quit order or other special orders). The quit orders or other special orders may be stored in a special table as desired. The backend signal 204 is delivered to system 72 and also to station 40. An operator may then be able to react to a data command to "quit" the garment (or other command) and not include the garment in the sorting rail system 50 or to place the garment on a different hook or rail system for alternative treatment or to include a flag or marker on the garment (which flag or marker may signify a subsequent command such as a repair or change order, quit, etc.). In one aspect the backend signal 204 may include repair instructions or a command to change a name or logo associated with the garment (or warn of a misplaced garment or other special instructions), or to undertake other special request in real-time. After an operator undertakes action based on signal 204 the operator may confirm completion by data input such that a confirming signal 206 is returned to system 72 and system 71. It may be appreciated that in some instances the information or command associated with the backend signal 204 may also be included with the information contained in signal 202.

An operator has the option to enter information or special requests at station 40 and to have such information fed to back-end system 71. Such two-way communication in real-time provides efficiency and allows for up-to-date information to be used by all operators in the system. The ability to update the back-end system 71 allows for system efficiency and better tracking and communication of tasks. An operator may enter the data into the backend system which is used in different locations such as at a specialty cell 510 or at second sort station 60 or for billing or other back-end purposes. Such communication provides enhanced quality control and allows operators to catch errors or flag special requests. The entry of the information to the back-end may occur in real time, further enhancing efficiencies. Additionally, the ability to receive real-time back-end data such as through signal 204, which information may also be send to second sort station 60, allows for handling quit notices or other special orders at second sort station 60. A user at second sort station 60 may also update the back-end with special request information, and may flag a garment for subsequent treatment. For instance, an operator at station 60 may recognize a torn pocket or missing button or other defect or situation to be corrected. The operator may flag the garment (with a physical indicator) and may also enter the data into the system and back-end system for tracking, processing and billing. After the garments have been slotted at station 60, the flagged garments may be removed for subsequent treatment (or quit) and returned to the location. When removed from the line the operator may place a placeholder flag for ease of replacing the garment after subsequent treatment. The flag may include human readable information. In some instances where there is a time delay in the laundering or processing of garments, the ability to receive real-time information at sort stations 40, 60 allows for improved control and processing of quit orders or special orders. In some cases if there are delays of several minutes or hours or days etc. the real-time data is updated and utilized even more effectively. It may be appreciated that under the present invention there is no need to re-sort the entire route or batch for a repair or special garment to be placed back into the route or batch because such garments are included at second sort 60 via delivery from special cell 510. The garment that is scanned at cell 510 is added to the slot list 75 and made available for the sort at sort 60, without having to resort the garments simply to include a garment from special cell 510. Garments arriving late to sort 40 (or not at all to sort 40) may be nonetheless scanned into the system and included at the second sort at sort station 60.

It may be appreciated that scanning at station 40 records data and instructions for each garment, and the databases, tables and information may be updated at both sorting system 72 and backend system 71. As each garment 20 of the batch is scanned at station 40 the database(s) are updated and the garment is directed to sorting system 50 or other location. The billing and accounting aspect of the backend system 71 is automatically and simultaneously (or nearly simultaneously) updated with a single scan at station 40. It may be appreciated that delivering real-time data from backend system 71 allows for efficient processing of garments. In a further aspect, a batch file or temporary file may be utilized at backend 71 to collect or provide a buffer table which may be input directly into the software/database of the Route Accounting System 71 at designated intervals. Use of such buffer table will avoid having to pass through the entry schemes and logic of a typical Route Accounting System in a piecemeal manner to accommodate efficient operation of the Route Accounting software. Heretofore such typical Route Accounting Systems were of a standalone variety independent of a sorting system, and the present invention comprises integrating such otherwise incompatible systems. Buffer tables may be utilized to provide efficient interface or data sharing among the systems, and the same may be automated for efficient operation. The automation may occur at short time intervals to approach real-time or near real-time sharing or update of information.

The garment-rail association 74 represents a predictive analysis of what garments are expected to be included in the present batch 30 (and respective routes 2W/3W, for instance). It may be appreciated that an operator and the system 100 is unaware of the exact nature or identity or other information of the garments of a batch 30 (other than they are generally grouped according to the identified batch or routes). It may be appreciated that the garments may be laundered without having to make a pre-identification, i.e., there is no initial or in-scan of any garments associated with system 100. In one aspect there is no scan of the garments until after they are washed and dried. It may also be appreciated that the batch 30 may be but does not need to be a single-route batch. The present system handles mixed route batches 30. The predictive analysis or algorithm using historical data estimates or predicts that garments associated with particular wearers are expected in the batch 30. The software may be programmed to accommodate for trends or patterns or behaviors of customers or wearers to assist in providing an accurate predicted wearer-rail association. The software program may evolve and be re-programmed based on additional factors to consider from time-to-time. The wearer-rail association 74 is created without having the benefit of knowing exactly which garments are present in the batch 30. Yet the sorting operation (i.e., scan 230 and delivery/sort to sort rail 240) is undertaken in the present invention despite not knowing or having previously scanned or identified all of the garments 20 of the batch 30. The system saves time and expense in that no pre-scan of garments is required. Use of a predictive algorithm is also helpful in attempting to determine which garments/wearers are to be expected or received, yet even a predictive algorithm may sometimes fail to predict certain outliers such as when a garment has not been received for several months is unexpectedly present when scanned at station 40. In such case, the wearer-rail association 74 accommodates even such unpredicted occurrence (which could not be anticipated or predicted by historical algorithms) by utilizing built-in wearer-placeholders or buffer positions on the respective rails 52. Elimination of a pre-scan requirement also provides operator flexibility in that there is less resistance to combining loads or routes into a batch. Because a user may combined the garments without having to make a pre-scan, time is saved and the operator is more inclined to undertake the combination rather than avoid the re-scan and use inefficient batching (small batches).

Figure 5:
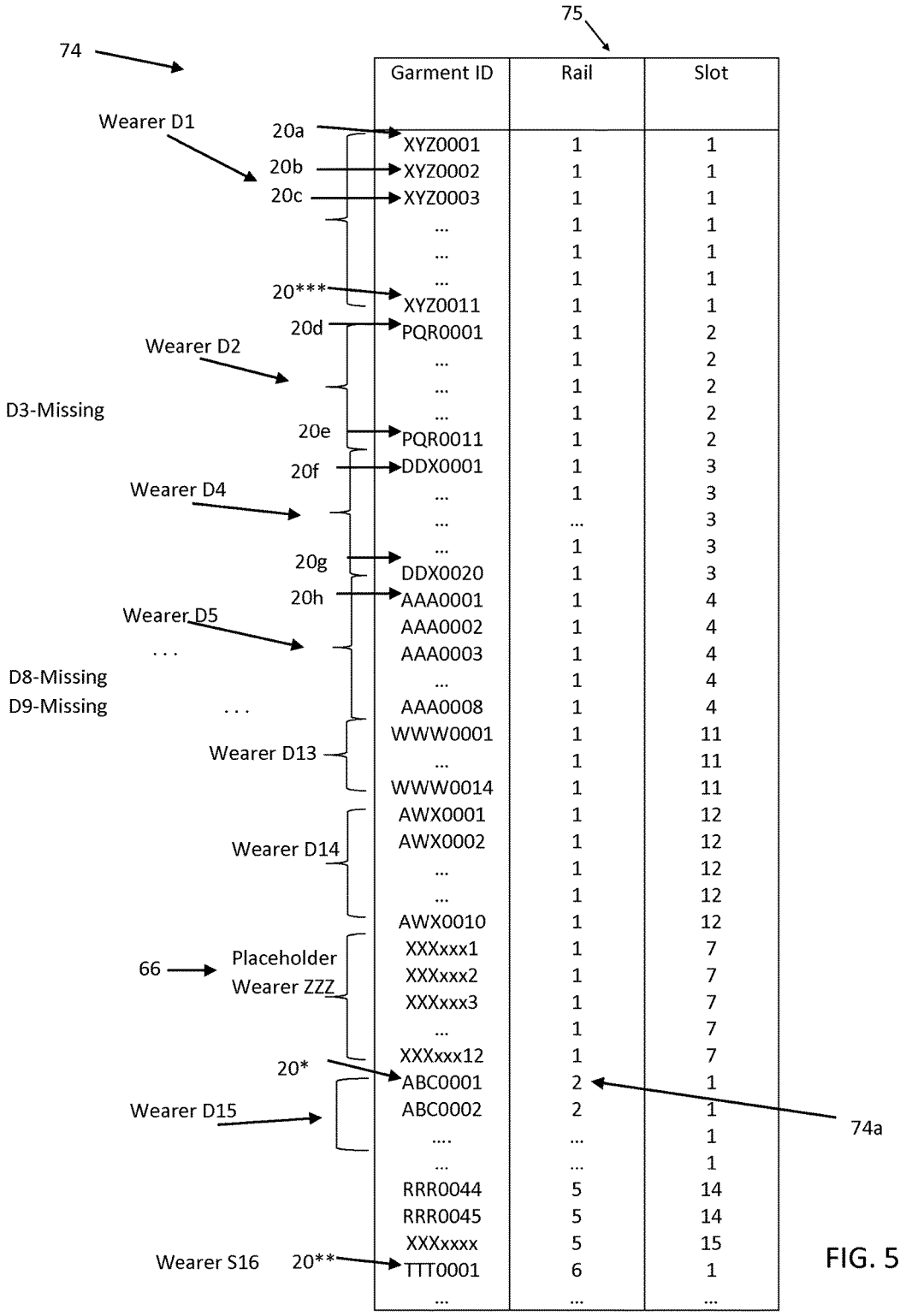
FIG. 5 is a table in accordance with a further aspect of the present invention

An example of a wearer-rail association is presented in FIG. 5, where garment 20*a* having Garment ID XYZ0001 belongs to Wearer D1 (which garment-wearer association may be found in a garment look-up table). Wearer D1 is associated with Rail 1 (via the wearer-rail association 74 described above). Whereas garment 20* having Garment ID ABC0001 is associated with Wearer D15, which in turn is associated with Rail 2. Different garment ID's and formats may be used for identification; the ID's presented herein are for example only. The respective wearer-rail associations 74 are established prior to scanning any of the garments 20 (step 220). It may be appreciated that scanning garments themselves may be used to initiate (i.e., step 205) if garments representing the respective batch and routes are scanned so that computing device 70 may ascertain which routes and historical information to use for creating and presenting an appropriate garment-rail association 74.

Upon scanning a garment the computing device 70, 72 displays or presents rail information for the particular garment 20. For instance, the number or identity of the rail 52 associated with the particular wearer/garment may be displayed or communicated to the operator. The operator places the garment on the identified rail 52 (step 240). For instance, with respect to FIG. 4 and FIG. 5, if a garment such as garment 20* (ID ABC0001, which happens to be associated with wearer D15 via a pre-set table of wearer-garment associations) is scanned at step 230, the sorting system 72 will display or communicate the wearer-rail association 74 value of rail number "2" (See FIG. 4 and FIG. 5). Particularly, wearer-rail association 74 associates garment belonging to Wearer D15 (such as garment 20* having Garment ID ABC0001 and associated with wearer D15) with rail number "2". The operator will place the garment on rail 2. When the garment 20* is scanned, garment-slot association table 75 is updated to include garment 20* and the associated slot number (and wearer). The table 75 is used in the second sort as noted below. The garment-slot association 75 evolves (updates) as additional garments are scanned, and the garment-slot numbers may be modified based on the actual garment identifications that are finally scanned into the system. The next garment will be scanned, which might be such as garment 20 having ID TTT0001 with associated wearer S16 which corresponds to rail "6" (See FIG. 4, FIG. 5). The rail number will be communicated so the operator will place garment 20** on rail "6". Yet another garment will be scanned, such as garment 20*** (ID XYZ0011) associated with wearer D1 which corresponds to rail "1". It may be appreciated that the garments may be laundered and scanned at station 40 randomly. When all of the garments 20 of batch 30 have been scanned and placed on their respective rails 52, the garment-slot association 75 will be complete (updated) and the garments 20 may be slid or removed from system 50 to single sort rail 56. Thereafter the garments are delivered to second sort station 60 for processing. The slot information of slot association table 75 is delivered to sort station 60** for slotting which groups the garments together by wearer.

With further reference to FIG. 4 and FIG. 5, a sort algorithm or software program creates instructions or a sequence which arranges the garments automatically in a desired wearer-rail association 74 and garment-slot association 75. In one instance, Rail 1 may be designated as containing garments for a last wearer of a last customer at a last stop on a particular route. When garments 20*a*, 20*b* and 20*c* which are associated with wearer D1 are scanned (step 230) they are placed on rail 1 as instructed in FIG. 4 and the association 75 of FIG. 5 is updated to include the scanned garments. Once scanned, garments associated with other wearers which in turn are associated with Rail 1, such as garments 20*d*, 20*e*, 20*f*, 20*g* and 20*h*, are added to the listing and/or the garment-slot association 75 is updated. Garments need not be identified in sequential order by wearer and random identification numbers may be utilized and stored/cataloged for recall by the computing device 70. Several garments may be associated with a single wearer (of a single customer at a single stop on a particular route). Multiple wearers may be associated with a single Rail. In one aspect, a single rail 52 may hold about 200 separate garments. Different size rails may also be used to hold more or fewer garments. In a typical application, the number of garments that a single wearer will have in a batch will be about 15 garments, although more or fewer garments may be accommodated. In some aspects, if there are no garments present in the batch that belong to a wearer designated for a particular rail, such rail might not be used or may be left without receiving any garments from the sort.

In the example with respect to FIG. 5 there may be numerous rails included with the association 74. The number of rails in the association 74 may correspond to the number of rails 52 of sorting rail system 50 shown in FIG. 1. System 50 may have 20 rails in one example. It may be appreciated that system 50 may have more or less than 20 sorting rails 52, and that more or less than 20 rails may be included with the association 74.

As may be appreciated with respect to FIG. 5, each of the scanned garments of batch 30 is associated with at least one of the rails 52 and at least one slot. A specified number of wearers may be designated for each rail 52. As shown in FIG. 5, and for example purposes only, garments associated with fifteen wearers, i.e., wearers D1-D14, plus Placeholder Wearer ZZZ, are expected to be positioned on Rail 1. Only if a garment is actually received or scanned at the first sort, however, is the table updated to include the garment and associated rail and/or slot (see below for slot designation). For instance, garments with the prefix XYZ (XYZ0001, XYZ0002, XYZ0003, . . . XYZ0011; i.e., eleven separate garments) belong to a first wearer D1 in the example were all scanned or received, while the garments having garment ID's of similar prefix belong to respective additional wearers of the example were also received or scanned, i.e., wearers D2 (PQR), D4 (DDX), D5 (AAA), D13 (WWW) and D14 (AWX). Ten different garments were received for wearer D14. A Garment ID need not include any particular scheme or sequence (i.e., the ID may be random) and a memory or table or database may be established to keep track of which particular garments or ID's are associated with a particular wearer. The garments in the example include IDs having similar wearer prefixes for ease of illustration. As shown in FIG. 5, wearer D15 is the first wearer associated with Rail 2. As shown in the example, no garments were received for Wearer D3; however, with reference to FIG. 4, garments were expected to be received for Wearer D3 and a space on Rail 1 was reserved for garments belonging to Wearer D3. Because no garments were received for wearer D3, there was no corresponding update to the slot association 75 because there were no actual garments to be slotted for that wearer. Also missing were garments associated with Wearer D8 and Wearer D9. The absence of garments associated with these two wearers accounts for why the related slot numbering (garment-slot association) 75 is presented where garments associated with Wearer D13 are placed into slot 11 instead of slot 13 (or are designated to be placed into slot 11). Garments for Wearer D4 were placed in slot 3 (or were designated to be placed into slot 3) because there were no garments for Wearer D3 (otherwise such garments for Wearer D4 would likely be placed in slot 4). In the example, garments for Wearer D14 are placed in slot 12. Garments received for unexpected Placeholder Wearer ZZZ are placed in slot 7 (or such garments may be placed in a different slot according to a desired or logical placement). Unexpected Wearer ZZZ garments might logically be grouped next to garments in slot 6, for instance, if the garments of slot 6 and slot 7 logically belong to the same stop or locker, or the unexpected Wearer ZZZ garments might be designated for a different slot according to a different desired or logical stop or locker depending on the case). Also as may be appreciated from the example of FIG. 5, no garments were received for wearers D8 and D9. While garments in the example were received for wearers D6, D7, D10, D11 and D12, those garment IDs and rail or slot associations would be present in the table or database of the invention but are not shown in FIG. 5 for simplicity. Further aspects of the slotting association are described below.

The garments may be delivered to a sort rail (step 240) and then delivered to a second sort (step 260). Second sort station 60 is configured for a second scan and second sorting of garments. Station 60 includes a scanning device 42 and a computing device and/or computer terminal and/or monitor and/or input. Station 60 may be linked to (including networked or configured to communicate with) the computing device 70 described above, including sorting system 72. In one aspect a garment 20 of the batch 30 is scanned at scanning device 42 of sort station 60. The first garment 21 scanned at station 60 (step 270) provides data information to computing device 70 (particularly front end 72) so that the particular batch 30 to be scanned is identified. Alternatively, an operator may input to computing device the identity of the batch 30. Upon identification of the batch 30 by sorting system 72, a garment-slot association is generated by computing device 70, 72. Alternatively, the garment-slot association 75 that was created/updated as noted above is delivered to sort station 60 (or is already delivered upon completion of scan of all garments of the batch at the first scan). Particularly, and upon completion of the scans of the entire batch 30 at station 40, each of the garments of the batch 30 has been identified for the second sort. With such complete identification information the system 100 is configured to generate a complete sort list of the known and present garments. Thus, a garment-slot list 75 may be generated or updated (step 250). The garment-slot list associates each respective garment with a slot 64 at station 60. The garment-slot list 75 may be represented in a table format (similar to the format of FIG. 5, for instance) or other data format for keeping track of and looking-up associated garment-slot data. The garment-slot list may also take into consideration garments 20 from special cell 510. Garments 20 may be scanned at cell 510 and the associated data incorporated into the garment slot data 75 for purposes of sorting at second sort station 60. Garments 20 received at station 510 may be scanned into the system without first designating a batch and even prior to laundering of other garments of its route. In this manner the garments 20 at the specialty station 510 are not forgotten and are tracked for merging within a correct batch/route at second sort 60. Having garments scanned at station 510 will allow for slot reservation at second sort 60. Because specialty cell 510 may require more treatment time for garments it is desired to route such garments to cell 510 early in the process so they may be matched together with the other garments of the batch/route.

In one aspect, station 60 includes a slot row 62. A slot row rail 63 may span the slot row 62 and is configured to receive the hanging garments. In one aspect slot row 62 includes a plurality of designated slots 64. Each individual slot 64 is designated to receive the garment or garments belonging to an individual wearer. Thus, when a garment is scanned, the associated garment-slot association 75 will direct the operator where to place the garment. For instance, if a garment is scanned and the station 60 communicates a slot "4" to the operator (corresponding to the compiled garment-slot association 75), the operator will place the garment (step 275) on slot row rail 63 in "slot 4" generally as shown in FIG. 1. In one aspect, "slot 4" will include an indicator at or adjacent to the "slot 4" to aid the operator in placing the garment on the slot row rail 63 associated with the slot 64, such as slot 64*d*. Station 60 may also communicate to the operator the designated slot number (or other designation such as a letter or symbol or other designation) by displaying the same on a display screen. Station 60 may also communicate with an audible address stating "Four" as an audible cue to the operator for proper placement. Additionally, the slot row 62 may include display signs of the respective slot numbers (or other identifiers) to assist the operator in locating the proper slot 64. It may be appreciated that system 60 may provide simultaneous communication to the operator of the various indicators (i.e. simultaneously display the "4" on the screen while providing the "Four" audible cue, while also illuminating the slot "4", which also includes a sign showing "4"). An operator may therefore scan a garment and immediately place the garment on the rail 63 and in the proper slot. It may also be appreciated that the operator may elect to arrange garments within a single slot for ease of use or storage, such as by switching the order of garments in a slot 64 to arrange pants with pants and shirts with shirts for easier handling. After one garment is placed in the designated slot, another garment may be scanned and placed in a slot (step 275). It may be appreciated that an operator may scan and place several garments very quickly, and may use one hand per garment (if desired) as he or she scans and places garments in rapid succession. When all of the garments associated with the particular wearers (i.e., in this example, the garments associated with wearers of Rail 1) have been slotted, station 60 will signal completion of the set of garments/wearers (associated with Rail 1) so that the operator may transfer the slotted garments to a different location for processing and delivery.

Another set of garments, such as those associated with Rail 2 may slide forward for scanning at station 60 as was done with garments of Rail 1. In one aspect the slotted garments 68 may slide as a set along rail 63 which extends past slot row 62. This clears the slot row 62 for the next set/Rail of wearers/garments to be slotted. It may be appreciated that slot row 62 may be configured with more than six slots 64 as illustrated (such as 15 slots, or other number of slots, for instance), so that a more efficient slotting of the batch may occur. Successive sets of wearer/garments (Rails) may be processed until all of the garments of the batch 30 have been slotted. Once all garments have been slotted, system 60 provides an indicator of the completion and may be poised for receiving rail-order garments from a different or new batch 30', including batches from different cells. In one aspect, all of the garments appearing in a particular rail and to be slotted will be listed on a display screen. A user will be able to see the list shrink as the individual garments are scanned and slotted. Even before scanning a particular rail of garments, the display may present an indicator which directs the operator that additional garments are available for inclusion with the slotting, such as garments from a specialty cell 510, or new garments to be filtered into the batch. The garments from cell 510 may be placed adjacent station 60 for convenience of adding when station 60 informs the operator of the existence of the garments to be slotted. The system will also alert the operator that garments from cell 510 are or will be required for slotting when a first garment of the rail to be slotted is scanned. The operator may walk to cell 510 to retrieve the related garments for slotting. Such garments may be grouped together for easy retrieval. In other aspects an operator from cell 510 may deliver the grouped documents for inclusion with the batch at the second sort station 60. When slotting of one rail of garments is completed, the screen may display the next set or rail of garments to be slotted.

Slot row 62 includes a limited number of slots 64. In the example shown in FIG. 1 the slot row 62 includes at least six slots numbered 1 through 6, but it may be appreciated that more (or less) than six slots may be used. For instance, slot row 62 may include 15 slots (which corresponds to the number of wearers/placeholders shown in FIG. 4, which corresponds to the set number of wearers to be designated per rail 52). In one aspect, the number of slots 62 will be at least as many as the number of designated wearers per rail. In one aspect, the garments positioned on single sort rail 56 to be scanned at station 60, and especially those garments proximal to scanning device 42, are in rail order. For instance, where slot row 62 contains space for fifteen wearers, the garments on single sort rail 56 proximal to station 60 correspond to the next fifteen wearers (and in one aspect, the contents of a single Rail). This allows an operator to sort those garments for the fifteen wearers before proceeding to the next set or segment of wearers. In one example with respect to FIG. 1 and FIG. 4, the garments on rail 1 (which correspond to the fifteen wearers/placeholder as listed in FIG. 4—to the extend the garments arrive to be part of the batch) are lead onto rail 56 first and then delivered in rail order to station 60. For instance, the garments of rail 1 will be delivered to common single sort rail 56, then the garments from rail 2 will be delivered to common rail 56, then the garments from rail 3 and so forth to create garments on rail 56 that are in "rail order." It may be appreciated that different rail orders may be created (such as a reverse order). It may also be appreciated that a random order may be used, provided the order is tracked so that the second sort station is aware of which rail is set to be scanned, yet such random ordering may frustrate the desired route, stop, customer and locker arrangement for correct delivery.

In a case where garments for all of the expected wearers appear (i.e., where there are no surprises such as no-shows or garments associated with unexpected wearers), the garment-slot order may look similar or identical to the wearer-rail order of FIG. 4. Of course, the garment-slot order will be filled in with the particular garments that are actually received or scanned. The garment-slot order 75 may designate the garments associated with wearer 1 with slot 1, and the garments associated with wearer 2 with slot 2, etc. Where each rail is configured to hold garments of fifteen wearers, for instance, having fifteen available slots at station 60 provides sufficient space or room for creating the final wearer sort. As the garments from the first rail (Rail 1) (which contain those garments only associated with the designated fifteen wearers) make their way to the scanner 42, the garments are sorted into their respective slots corresponding to the respective wearer. Thus, all of the garments belonging to a particular wearer will be grouped together and configured for delivery together with garments belonging to other wearers of the same customer, stop, locker room and/or route.

In one aspect the system 100 of the invention includes programming such that the number of wearers designated for each rail 52 corresponds to the number of slots at station 60. In one aspect the number of wearers on the rails 52 is the same as the number of slots at slot row 62. In other aspects, and since it may be appreciated that operators may be flexible and adjust to changing circumstances, in the case where for some reason a garment is included on a rail 52 belonging to a $16^{th}$ wearer (while slot row contains only 15 designated slots) the operator may place the "extra" garment (or garments associated with the $16^{th}$ wearer) at a makeshift slot 65. In one aspect a makeshift slot 65 may appear before slot "1" or after slot "15" or at some other designation or rail position. The makeshift slot 65 may be used for retaining garments from or associated with the additional wearer. It may be appreciated that a makeshift slot 65 may be used where the number of slots 64 is greater or less than the example of 15 slots 64. More than one makeshift slot may be utilized for sorting. Because all of the garments contained in a batch 30 will have been scanned and placed at rail 56 (and all of the garments at special cell 510 will also have been scanned), a complete set of garment-slot information may be created by front end system 72 for use at second sort 60. In the absence of human error (such as an operator making no mistakes in placing a garment on the correct rail 52 or on a correct slot 64, and where there are no mechanical delivery problems with delivering a garment to a correct rail 52), the order of garments after the second sort will be perfect (or at least arranged by proper route, stop, customer, locker and wearer order; with all wearer garments grouped together). This is the case even with a batch 30 consisting of garments from multiple routes despite only undergoing only two sorts (again, assuming no user error). Heretofore more than two scans was required to provide a complete sort where a batch includes multiple routes.

In a further aspect of the invention, system 100 is configured to accommodate surprises or situations where the batch 30 comprises something other than the expected or predicted garments. For instance, operators washing garments received from the delivery trucks are not aware of the identity of each of the garments (or associated wearer) delivered from a route or comprising a batch 30. Under the present system it is not necessary to conduct an in-scan of the garments 20. Stray garments may be included in batch 30. It may be the case where a wearer's garments are included in a batch unexpectedly, such as the garment is picked up on the route earlier (or later) than scheduled or for other reasons. It may also be the case that new employees or wearers are introduced by a customer and the new garments appear in the batch. There may be other scenarios where additional or unexpected garments appear in the batch 30 (or where expected garments are not present in the batch). A garment may also arrive late, and under the present system the batch need not be re-sorted to include the late garment with the batch. A garment may also be added to a batch any time before the second sort. In these cases system 100 is configured to nonetheless handle appropriate laundering and sorting of the garments. A proper order may be establish even with mixed route garments after only two scans and also where the garments do not repeat a flow path.

In one aspect each of the "surprise" garments 20 includes a tag and associated wearer, customer, locker room, stop and/or route. The garment-rail association 74 is configured to include at least one "placeholder" wearer designation 66. For instance, a rail such as rail 1 may include a placeholder wearer designation 66 (configured by software/algorithm or by or with computing device 70, for instance) so that if and when a garment associated with a route (or routes) of the batch 30 logically belongs to the same stop, same customer or same locker as other garments of rail 1, the placeholder wearer designation 66 is used for the unexpected garment which may be placed on rail 1. For instance, the unexpected garment might logically belong to route 3W (based on past experience) but may have been absent for a period of time from the regular laundering system (and thus not included in the present predicted sort or garment-rail association 74). When the unexpected garment (associated with a wearer that is unexpected) is scanned at station 40, the route, stop, customer, locker and wearer (or other information) is available from computing device 70. If the unexpected garment logically belongs to route 3W, and is associated with the other wearers at rail 1, the unexpected garment will be placed on rail 1 and an association with the unexpected wearer will be established. The database and related garment-rail association will be updated, with the unexpected wearer now being the placeholder wearer. The updated data will also be available for the second sort at station 60. In such case, an association with a slot 64 is created for the unexpected garment and wearer. A makeshift slot is not necessarily required because the wearer is now accounted for in preparing the garment-slot association 75 and there will be a slot designated for the surprise wearer. Multiple rails 52 may include a placeholder wearer designation 66 for flexibility in receiving and sorting unexpected garments. In one aspect, each of the rails 52 may include a placeholder designation 66. It may also be appreciated that more than one placeholder wearer designation 66 may be included or associated with a given rail 52. In one aspect, each of the rails 52 may include at least two (or even more if desired) placeholder wearer designations 66.

It may be appreciated that where the rails 52 are configured to receive 15 wearers (including placeholders 66), that second sort slot row 62 may be consistent in providing 15 slots 64. With such configuration each rail may then be sorted by conveniently placing the respective garments belonging to each wearer on the rail into their associated slots 64.

When an unexpected garment is scanned, the garment-slot association 75 will include the unexpected garment for sorting at station 60. An associated slot 64 will be reserved for the unexpected garment (even though the garment was not originally predicted to be present in the batch 30).

It may be the case that expected garments from a wearer do not appear in the batch 30. In such case the designated position on a rail 52 might not be or is not filled. In other aspects the set number of wearers per rail established at step 220 will be less than the number of slots 64. This will spread the garments of the batch 30 over more of the rails (i.e. spread throughout the 20 rails as in FIG. 1) which will ease the step of slotting the garments in the second sort. For instance, an operator sorting a rail that has only seven or eight associated wearers is easier to sort compared to a rail having fifteen wearers/placeholders per rail because the operator will have a smaller area to manage (and will not have to walk or strain to slot the garments throughout a longer array of slots). In one example, where only 150 wearers are predicted to appear in a batch 30, and despite having 20 rails 52 for sorting and despite having a second sort slot row which accommodates 15 slots, the software may present a wearer-rail association 74 utilizing only 7 wearers per rail (utilizing all 20 rails as opposed to utilizing only a subset of the 20 rails). Such arrangement of spreading the garments over the entire array of rails, despite having so few of wearers, makes it easier to sort the garments at the second sort. In some instances it may be that an entire rail 52 remains empty upon completion of the scan of the batch 30.

Figure 6:
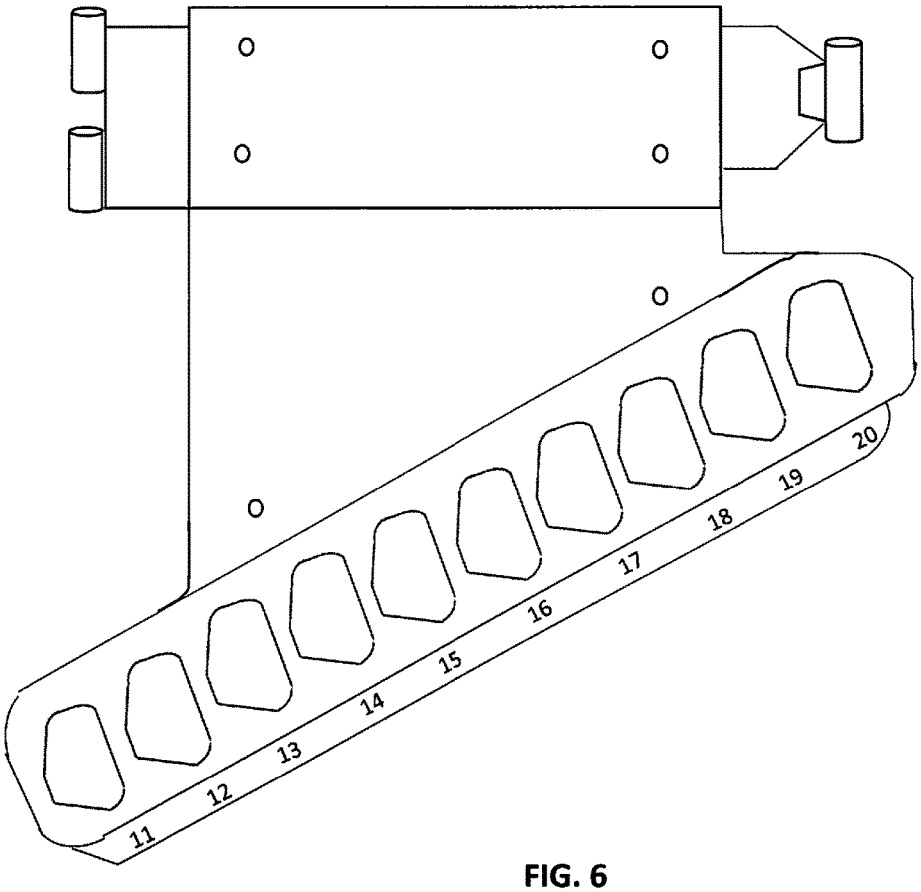
FIG. 6 (Prior Art)
FIG. 6 is a side view of a prior art component for use with a system aspect of the present invention.

In one aspect as shown in FIG. 1 and FIG. 6, a prior art card 54 having hooks 55 with associated rail numbers 52' may be used to assist an operator in delivering garments to respective rails 52. For instance, a series of cards 54 may be positioned on a circulating loop 58. Cards 54 may be hinged to other cards or otherwise linked to the continuous loop 58. As a card 54 circles the loop 58 a garment 20 which is hooked at a hook 55 will be transferred to an associated rail 52 by fingers or lifts associated with the sorting rail system 50. In one aspect card 54 is angled so that respective hooks 55 align with respective rails 52 (which respective rails are also or similarly aligned) so that placing a garment on a designated rail 52 is easily accomplished. For instance, upon scanning a garment the user simply places the garment (which is on a hanger) on the designated hook 55 which is conveniently circulating past station 40. As the card 54 follows the path of loop 58 the hanger on which the garment is positioned will be lifted onto the associated rail (i.e., placing a hanger in hook 52' associated with rail number "12" will deliver the garment to rail 52 designated as rail number "12"). It may be appreciated that under normal operation each garment will be delivered to a rail at a first instance and that garments do not circulate about loop 58 or otherwise do not repeat a path. It may also be appreciated that garments follow a one-way path. Other mechanisms may be used to assist an operator in delivering garments to respective and appropriate rails 52. After the batch 30 is delivered to single sort rail 56, the batch 30 is transferred to second sort station 60.

Figure 7:
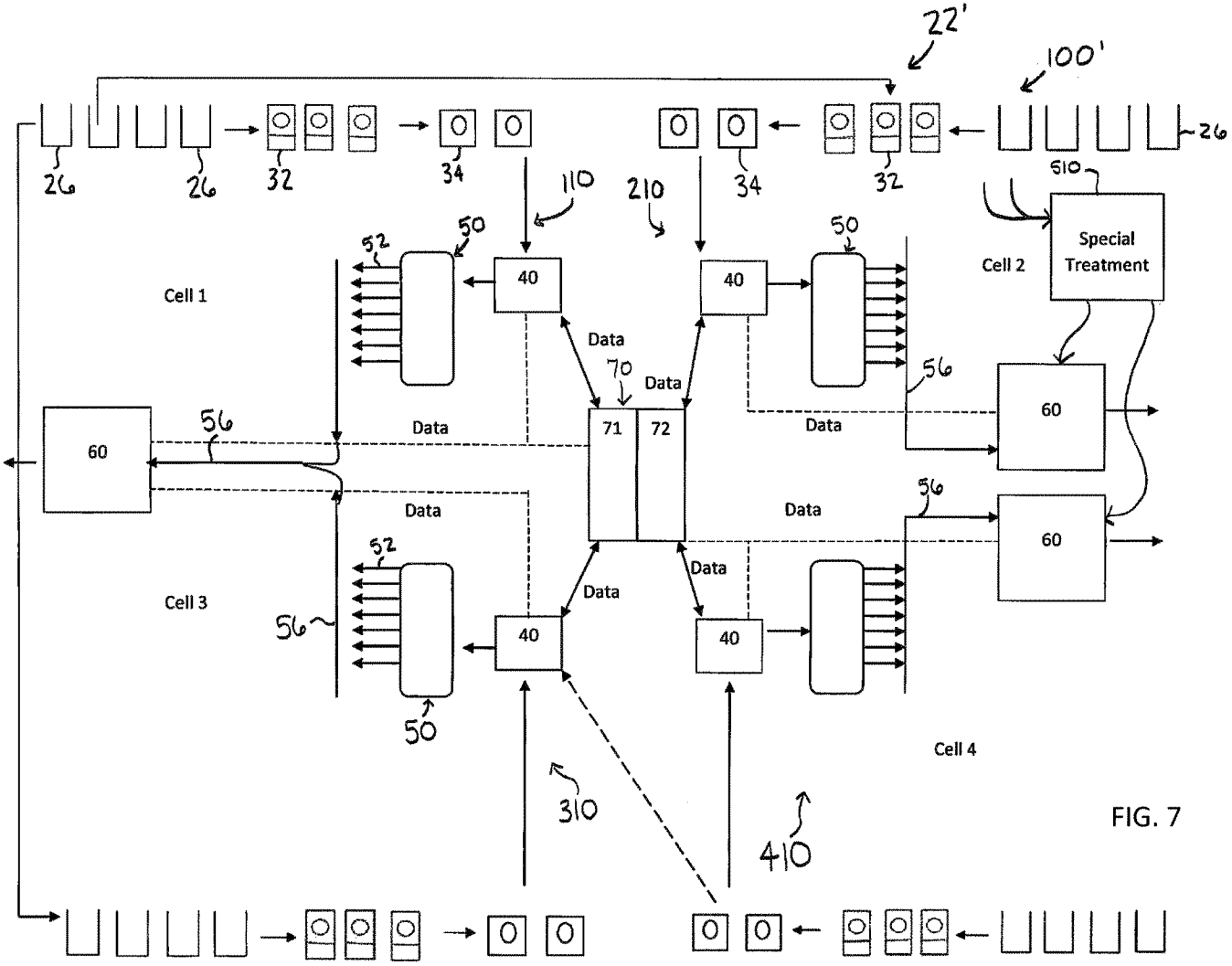
FIG. 7 is a schematic representation of a system and method for laundering and sorting garments in accordance with a further aspect of the present invention.

In a further aspect the invention includes a multi-cell system 100' and method of laundering generally shown with reference to FIG. 7. System 100' includes cells 110, 210, 310, 410 and special treatment cell 510. System 100' is scalable in that additional cells may be added or removed with relative ease. In one aspect each cell enjoys use of the common computing device 70 and may share additional components. Garments delivered to facility 20 may be placed in bins 26 and distributed among the various cells as desired. If one cell is under capacity, garments from different areas or cells of the facility 22 may be delivered or routed to the cell running under capacity. For instance garments in bin 26 may be routed to Cell 1 or moved to Cell 2 or other cells as may be appreciated. When garments are laundered in one cell they may also be delivered to a different cell for sorting in accordance with the invention. For instance garments laundered in cell 410 may remain in Cell 4 for sorting at station 40, or, if Cell 3 is open for capacity, garments from Cell 4 may be send to cell 3 and vice versa. A batch identifier 38 may accompany the batch as it progresses through the process so that an operator can enter the appropriate batch information into computing device 70 for sorting as described herein. The computing device 70 may be located within facility 22' or remotely. The positioning of computing device 70 as shown in FIG. 7 is for illustrative purposes only and device 70 may be positioned in different locations. Data, including Wearer-Rail association 74 data, and including computer instructions, code or programs, may be provided to first sort stations 40 remotely. A route information signal 201 may be delivered to computing device 70 via a remote connection or signal and a return signal 202 containing wearer-rail association data 74 may be provided on demand to a respective sorting system 72 or sorting station 40. Data such as garment slot association data 75 may be provided to second sort station 60 via computing device 70 and/or sorting system and/or sort station 40.

A special treatment cell 510 may handle repairs or pressing or other laundry treatment. After a garment is treated at cell 510 it may be transported to any of the other cells as appropriate and for inclusion with its designated or appropriate batch. In some aspects cells may utilize the same second sort station 60. Special treatment cell 510 may be located at different positions within facility 22', and additional special treatment cells 510 may be utilized. An operator may look to receive garments from cell 510, for instance, when conducting or prior to conducting a second sort at station 60. The operator may retrieve garments from cell 510 to include in the batch 30 being sorted at station 60. The garments at cell 510 may be assembled for ease of delivery to the respective stations 60. In one instance the garments from special cell 510 may be positioned on a supplemental rail 56' (See FIG. 1) for convenient scanning with the garments from rail 56 at station 60. Rail 56' may also be used for new garments or otherwise for garments to be included with an associated batch 30.

In operation, an operator may mix garments from different routes into batches that are laundered at any number of cells. After laundering the garments the batch may be sent to any number of different cells for sorting (keeping the batch together) where a first sort at a first sorting station 40 may be conducted. After the first sort is conducted the garments of the batch may be sent to any of the several second sort stations 60 (provided the related garment-slot 75 information accompanies the respective batch garments to the respective sort station 60). Providing multiple cells allows an operator to utilize the equipment most efficiently and make changes depending on corresponding changes to the work flow or facility.

It may be appreciated that with the present systems 100, 200, the overall sorting process of a batch 30 may be accomplished in a matter of a few hours or less given a volume of about 250-300 wearers. For instance, in one example the first scan may typically be completed between about 35 minutes to an hour and about 30 minutes to 45 minutes for the second scan/sort. Time may vary depending on the number of wearers/garments and special requests. Additional time is required for washing and drying or other treatment of the garments. After one batch has been sorted and removed from rail system 50, another batch sorting operation may immediately commence at station 40. It may also be appreciated that operator efficiency data may be collected throughout the process, such as the rate of scan, repairs made or identified, delays, time of day efficiencies, production per shift or per hour, etc. Such information may be useful for management of operators and resources.

An optional batching or bundle scan may be conducted after the second scan 60 is completed. While the bundle scan is an optional third scan, it typically is not required in order to achieve a proper route-ready sort. Yet the bundle scan may also be used for marketing or customer appeal to demonstrate the sort is indeed complete and accurate. Of course the bundle scan may also be used to catch human or mechanical errors and allow an operator the ability to provide the correct route sequence. The optional bundle sort may also present updated real-time data to the operator who may see a garment with a special order such as a quit order, or to determine if repairs were completed or needed, or special boxing or packaging or other instruction including instruction from the back-end system.

It should be understood, of course, that the foregoing relates to exemplary embodiments of the invention and that modifications may be made without departing from the spirit and scope of the invention as set forth in the following claims. The scope of this invention also includes embodiments having different combinations of features and embodiments that do not include all of the above described features.

What is claimed is:

1. A method of processing garments, said method comprising:

receiving individual garments from at least two routes combined into a single batch of mixed route garments;

first sorting each of the garments of the batch onto a plurality of sequenced sorting rails based on at least two levels of garment designation, the first sorting including first scanning of a garment associated with a particular wearer, wherein prior to the first scanning of the garment the wearer is associated with a particular rail of the plurality of sorting rails; and second sorting the garments in an order corresponding to the sequenced sorting rails, said second sorting arranging each garment in a correct delivery order sequence.

2. The method of claim 1 where said first sorting of the garments based on the at least two levels of garment designation includes arranging each of the garments based on route designation stop designation, and where said second sorting includes arranging each garment in a correct route, stop, customer and wearer order for delivery.

3. The method of claim 1 further comprising associating the wearer with a particular rail of the plurality of rails, the associating undertaken by a computing device based on a predictive software algorithm.

4. The method of claim 3 further comprising sending route identification information of at least one of the different delivery routes to a computing device which generates a wearer-rail association prior to said scanning.

5. The method of claim 4 where the wearer-rail association is generated for all wearers for which garments are predicted to be present in the batch whether or not a garment associated with a particular wearer is actually present for washing.

6. The method of claim 1 where each sorting rail is designated to receive garments associated with no more than a set number of wearers.

7. The method of claim 6 where said first sorting includes first scanning a garment and delivering the garment to a rail according to a wearer-rail association established prior to said first scanning.

8. The method of claim 1 where all of the garments avoid travel along a repeating path.

9. The method of claim 1 further comprising an operator assembling the individual garments from the at least two routes into the single batch of mixed route garments, the method further comprising washing and drying the batch of garments following said assembling and further comprises sending route identification information of at least one of the different delivery routes to a computing device which generates a wearer-rail association, the wearer-rail association created prior to a scanning of a garment during said first sorting.

10. The method of claim 1 where said first sorting each of the garments onto a plurality of sequenced sorting rails includes delivering an unexpected garment to a placeholder position on at least one of the plurality of sorting rails, the placeholder position established prior to commencement of said first sorting.

11. The method of claim 1 where said first sorting each of the garments includes scanning a garment at a sorting station, displaying at the sorting station wearer-rail association information received from a computing device and pertaining to the scanned garment, sending garment identification information to a computing device, and displaying at the sorting station status information pertaining to the scanned garment and received from a computing device, the status information includes one of status information from the group of a quit notice, a repair notice, a wrong-route notice, a special handling notice.

12. The method of claim 1 where said first sorting each of the garments includes scanning a garment at a sorting station, displaying wearer-rail association information received from a computing device pertaining to the scanned garment, and entering and sending garment information pertaining to the scanned garment from the sorting station to the computing device, the computing device including route accounting information.

13. The method of claim 1 further comprising adding a garment to the batch after delivering all of the garments of the batch to the plurality of sorting rails and before undertaking said second sort.

14. The method of claim 1 further comprising:

generating, by an application running on a computer system, a wearer-rail association where a set number of predicted wearers are associated with the plurality of sorting rails;

receiving, by the application, a signal identifying a garment associated with a wearer provided in the wearer-rail association; and responsive to said receiving, causing to be displayed on a display of the computer system, by the application, a designation of one of the plurality of the sorting rails upon which to place the garment.

15. The method of claim 14 where the signal identifying the garment is a radio-frequency identification (RFID) signal resulting from scan of an RFID tag associated with the garment, said method further comprising scanning an RFID tag associated with the garment and maintaining, by the application, a database containing the wearer-rail association and a rail-slot association.

16. The method of claim 14 where said generating the wearer-rail association occurs prior to said receiving of the signal identifying the garment associated with a wearer.

17. The method of claim 1 where the first sorting includes placing garments associated with a particular customer on at least two of the plurality of sorting rails while garments associated with a particular wearer are placed on only one of the plurality of sorting rails.

18. A method of processing garments, said method comprising:

receiving individual garments from at least two routes combined into a single batch of mixed route garments;

first sorting each of the garments of the batch onto a plurality of sequenced sorting rails based on at least two levels of garment designation; and second sorting the garments in an order corresponding to the sequenced sorting rails, said second sorting arranging each garment in a correct delivery order sequence where each sorting rail is designated to receive garments associated with no more than a set number of wearers, said second sorting includes placement of a garment in a slot associated with a wearer of the garment, the slot being one of a set number of slots, the set number of slots corresponding to the set number of wearers.

19. A method of processing garments, said method comprising:

receiving individual garments from at least two routes combined into a single batch of mixed route garments;

first sorting each of the garments of the batch onto a plurality of sequenced sorting rails based on at least two levels of garment designation; and second sorting the garments in an order corresponding to the sequenced sorting rails, said second sorting arranging each garment in a correct delivery order sequence, said method further comprising generating a wearer-rail association, where said first sorting each of the garments of the batch onto a plurality of sequenced sorting rails is based on the wearer-rail association.

20. The method of claim 19 where a garment of the batch includes a tag containing wearer information, said wearer-rail association is developed by a computing device prior to identifying the wearer information of the garment.

21. A method of processing garments, said method comprising:

receiving individual garments from at least two routes combined into a single batch of mixed route garments;

first sorting each of the garments of the batch onto a plurality of sequenced sorting rails based on at least two levels of garment designation; and second sorting the garments in an order corresponding to the sequenced sorting rails, said second sorting arranging each garment in a correct delivery order sequence, said method further comprising the step of designating the batch with a batch identifier having associated batch identifier information, providing the batch identifier information to a computing device, identifying a garment from the batch, and delivering the garment to one of the plurality of sorting rails based on a wearer-rail association developed by the computing device.

22. The method of claim 21 where the computing device generates a wearer-rail association upon receiving the batch identifier information, the wearer-rail association associates each of a group of anticipated wearers pertaining to the at least two routes with a respective sorting rail of a sorting rail system, the wearer-rail association generated at least in part with a software program utilizing a predictive algorithm.

23. The method of claim 22 where the wearer-rail association includes at least one rail placeholder position designated for unexpected garments.

24. The method of claim 22 where said identifying includes scanning the garments at a first sorting station, the method further comprising informing an operator of a status of a scanned garment and updating the computing device regarding the scanning of the garment, delivering each of the garments to a common rail in sorting rail sequence, providing sort data from the computing device to a second sort station, second sorting each of the garments at the second sort station into a correct route, stop, customer and wearer order for delivery.

* * * * *